US008378935B2

(12) United States Patent
Kimura et al.

(10) Patent No.: US 8,378,935 B2
(45) Date of Patent: Feb. 19, 2013

(54) DISPLAY DEVICE HAVING A PLURALITY OF SUBFRAMES AND METHOD OF DRIVING THE SAME

(75) Inventors: Hajime Kimura, Kanagawa (JP); Shunpei Yamazaki, Tokyo (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 0 days.

(21) Appl. No.: 13/461,464

(22) Filed: May 1, 2012

(65) Prior Publication Data

US 2012/0274614 A1 Nov. 1, 2012

Related U.S. Application Data

(63) Continuation of application No. 11/328,319, filed on Jan. 9, 2006.

(30) Foreign Application Priority Data

Jan. 14, 2005 (JP) ..... 2005-008419

(51) Int. Cl.
*G09G 3/30* (2006.01)

(52) U.S. Cl. ..... 345/76; 345/82

(58) Field of Classification Search ..... 345/76–77
See application file for complete search history.

(56) References Cited

U.S. PATENT DOCUMENTS

| | | | |
|---|---|---|---|
| 4,070,663 | A | 1/1978 | Kanatani et al. |
| 4,773,738 | A | 9/1988 | Hayakawa et al. |
| 5,091,722 | A | 2/1992 | Kitajima et al. |
| 5,200,846 | A | 4/1993 | Hiroki et al. |
| 5,225,823 | A | 7/1993 | Kanaly |
| 5,302,966 | A | 4/1994 | Stewart |
| 5,349,366 | A | 9/1994 | Yamazaki et al. |
| 5,414,442 | A | 5/1995 | Yamazaki et al. |
| 5,424,752 | A | 6/1995 | Yamazaki et al. |
| 5,471,225 | A | 11/1995 | Parks |
| 5,479,283 | A | 12/1995 | Kaneko et al. |
| 5,583,534 | A | 12/1996 | Katakura et al. |
| 5,600,169 | A | 2/1997 | Burgener et al. |
| 5,642,129 | A | 6/1997 | Zavracky et al. |

(Continued)

FOREIGN PATENT DOCUMENTS

| | | | |
|---|---|---|---|
| CN | 1369870 | A | 9/2002 |
| EP | 0 831 449 | A2 | 3/1998 |

(Continued)

OTHER PUBLICATIONS

Inukai, K. et al, "36.4L: Late-News Paper: 4.0-in. TFT-OLED Displays and a Novel Digital Driving Method," SID Digest '00: SID International Symposium Digest of Technical Papers, vol. 31, 2000, pp. 924-927.

(Continued)

*Primary Examiner* — Chanh Nguyen
*Assistant Examiner* — Long D Pham
(74) *Attorney, Agent, or Firm* — Husch Blackwell LLP

(57) ABSTRACT

In a display device in which one frame is divided into a plurality of subframes and a gray scale is expressed by a time gray scale method, there is a problem of pseudo contour. A gray scale is expressed by sequentially adding a weight of each subframe (light emission period, light emission time, and the like). Further, an erasing diode is provided in a pixel. By turning this erasing diode on, the signal stored in the pixel is erased, thereby a non-light emission period is provided. Accordingly, subframes with different light emission periods can be easily formed.

10 Claims, 24 Drawing Sheets

U.S. PATENT DOCUMENTS

| | | | | |
|---|---|---|---|---|
| 5,712,652 | A | 1/1998 | Sato et al. | |
| 5,767,828 | A | 6/1998 | McKnight | |
| 5,798,746 | A | 8/1998 | Koyama | |
| 5,969,710 | A | 10/1999 | Doherty et al. | |
| 5,986,640 | A | 11/1999 | Baldwin et al. | |
| 5,990,629 | A | 11/1999 | Yamada et al. | |
| 6,034,659 | A | 3/2000 | Wald et al. | |
| 6,040,819 | A | 3/2000 | Someya | |
| 6,091,203 | A | 7/2000 | Kawashima et al. | |
| 6,097,358 | A | 8/2000 | Hirakawa et al. | |
| 6,144,364 | A | 11/2000 | Otobe et al. | |
| 6,157,356 | A | 12/2000 | Troutman | |
| 6,215,466 | B1 | 4/2001 | Yamazaki et al. | |
| 6,222,512 | B1 | 4/2001 | Tajima et al. | |
| 6,229,506 | B1 | 5/2001 | Dawson et al. | |
| 6,229,508 | B1 | 5/2001 | Kane | |
| 6,249,265 | B1 | 6/2001 | Tajima et al. | |
| 6,292,159 | B1 | 9/2001 | Someya et al. | |
| 6,369,782 | B2 | 4/2002 | Shigeta | |
| 6,373,454 | B1 | 4/2002 | Knapp et al. | |
| 6,417,835 | B1 | 7/2002 | Otobe et al. | |
| 6,448,960 | B1 | 9/2002 | Shigeta | |
| 6,452,341 | B1 | 9/2002 | Yamauchi et al. | |
| 6,518,977 | B1 | 2/2003 | Naka et al. | |
| 6,542,138 | B1 | 4/2003 | Shannon et al. | |
| 6,563,480 | B1 | 5/2003 | Nakamura | |
| 6,563,486 | B2 | 5/2003 | Otobe et al. | |
| 6,614,413 | B2 | 9/2003 | Tokunaga et al. | |
| 6,710,548 | B2 | 3/2004 | Kimura | |
| 6,741,227 | B2 | 5/2004 | Naka et al. | |
| 6,778,152 | B1 | 8/2004 | Huang | |
| 7,057,584 | B2 | 6/2006 | Jeong | |
| 7,088,052 | B2 | 8/2006 | Kimura | |
| 7,345,682 | B2 | 3/2008 | Honda et al. | |
| 7,352,375 | B2 | 4/2008 | Yamazaki et al. | |
| 2001/0045923 | A1 | 11/2001 | Otobe et al. | |
| 2002/0005844 | A1 | 1/2002 | Kosaka et al. | |
| 2002/0015011 | A1 | 2/2002 | Honda et al. | |
| 2002/0030671 | A1 | 3/2002 | Shigeta et al. | |
| 2002/0047852 | A1 | 4/2002 | Inukai et al. | |
| 2002/0081773 | A1 | 6/2002 | Inoue et al. | |
| 2002/0135312 | A1* | 9/2002 | Koyama | 315/169.3 |
| 2003/0025656 | A1 | 2/2003 | Kimura | |
| 2003/0057423 | A1 | 3/2003 | Shimoda et al. | |
| 2003/0057895 | A1* | 3/2003 | Kimura | 315/370 |
| 2003/0058195 | A1 | 3/2003 | Adachi et al. | |
| 2003/0090444 | A1 | 5/2003 | Jeong | |
| 2003/0117351 | A1 | 6/2003 | Hoshino | |
| 2003/0128199 | A1 | 7/2003 | Kimura | |
| 2004/0227707 | A1* | 11/2004 | Inukai | 345/76 |
| 2004/0263434 | A1 | 12/2004 | Otobe et al. | |
| 2004/0263444 | A1 | 12/2004 | Kimura et al. | |
| 2005/0082957 | A1 | 4/2005 | Hoppenbrouwers et al. | |
| 2005/0093791 | A1* | 5/2005 | Lo | 345/82 |
| 2005/0179628 | A1 | 8/2005 | Kimura | |
| 2006/0139265 | A1 | 6/2006 | Kimura | |
| 2007/0035488 | A1 | 2/2007 | Kimura | |

FOREIGN PATENT DOCUMENTS

| | | | |
|---|---|---|---|
| EP | 0 838 799 | A1 | 4/1998 |
| EP | 1 184 833 | A2 | 3/2002 |
| EP | 1 187 087 | A1 | 3/2002 |
| EP | 1 231 592 | A2 | 8/2002 |
| EP | 1 315 139 | A2 | 5/2003 |
| EP | 1 450 337 | A2 | 8/2004 |
| JP | 7-49663 | | 2/1995 |
| JP | 7-175439 | | 7/1995 |
| JP | 7-271325 | | 10/1995 |
| JP | 9-34399 | | 2/1997 |
| JP | 9-172589 | | 6/1997 |
| JP | 10-31455 | | 2/1998 |
| JP | 10-171401 | | 6/1998 |
| JP | 10-307561 | | 11/1998 |
| JP | 10-319903 | | 12/1998 |
| JP | 11-305726 | | 11/1999 |
| JP | 2000-35774 | | 2/2000 |
| JP | 2003-195813 | | 7/2003 |
| JP | 2003-330420 | | 11/2003 |
| JP | 2004-252186 | | 9/2004 |
| WO | WO 99/60557 | A1 | 11/1999 |
| WO | WO 99/65012 | A2 | 12/1999 |
| WO | WO 01/52229 | A1 | 7/2001 |
| WO | WO 03/075252 | A2 | 9/2003 |

OTHER PUBLICATIONS

Inukai, K. et al, "36.4L: Late-News Paper: 4.0-in. TFT-OLED Displays and a Novel Digital Driving Method," SID 00 Digest, 2000, pp. 924-927.

Office Action re Chinese patent application No. CN 200610005123.X, dated Jan. 8, 2010 (with English translation).

* cited by examiner

FIG. 1

| *1 / *2 | SF1 | SF2 | SF3 | SF4 | SF5 | SF6 | SF7 |
|---|---|---|---|---|---|---|---|
| | 4 | 4 | 4 | 4 | 4 | 4 | 4 |
| 0 | × | × | × | × | × | × | × |
| 1 | × | × | × | × | × | × | × |
| 2 | × | × | × | × | × | × | × |
| 3 | × | × | × | × | × | × | × |
| 4 | ○ | × | × | × | × | × | × |
| 5 | ○ | × | × | × | × | × | × |
| 6 | ○ | × | × | × | × | × | × |
| 7 | ○ | × | × | × | × | × | × |
| 8 | ○ | ○ | × | × | × | × | × |
| 9 | ○ | ○ | × | × | × | × | × |
| 10 | ○ | ○ | × | × | × | × | × |
| 11 | ○ | ○ | × | × | × | × | × |
| 12 | ○ | ○ | ○ | × | × | × | × |
| 13 | ○ | ○ | ○ | × | × | × | × |
| 14 | ○ | ○ | ○ | × | × | × | × |
| 15 | ○ | ○ | ○ | × | × | × | × |
| 16 | ○ | ○ | ○ | ○ | × | × | × |
| 17 | ○ | ○ | ○ | ○ | × | × | × |
| 18 | ○ | ○ | ○ | ○ | × | × | × |
| 19 | ○ | ○ | ○ | ○ | × | × | × |
| 20 | ○ | ○ | ○ | ○ | ○ | × | × |
| 21 | ○ | ○ | ○ | ○ | ○ | × | × |
| 22 | ○ | ○ | ○ | ○ | ○ | × | × |
| 23 | ○ | ○ | ○ | ○ | ○ | × | × |
| 24 | ○ | ○ | ○ | ○ | ○ | ○ | × |
| 25 | ○ | ○ | ○ | ○ | ○ | ○ | × |
| 26 | ○ | ○ | ○ | ○ | ○ | ○ | × |
| 27 | ○ | ○ | ○ | ○ | ○ | ○ | × |
| 28 | ○ | ○ | ○ | ○ | ○ | ○ | ○ |
| 29 | ○ | ○ | ○ | ○ | ○ | ○ | ○ |
| 30 | ○ | ○ | ○ | ○ | ○ | ○ | ○ |
| 31 | ○ | ○ | ○ | ○ | ○ | ○ | ○ |

*1: Light emission period

*2: Gray scale level

○: Light emission

×: Non-light emission

FIG. 2

| *1 / *2 | SF1 | SF2 | SF3 | SF4 | SF5 | SF6 | SF7 | SF8 | SF9 | SF10 |
|---|---|---|---|---|---|---|---|---|---|---|
| | 3 | 3 | 3 | 3 | 3 | 3 | 3 | 3 | 3 | 3 |
| 0 | × | × | × | × | × | × | × | × | × | × |
| 1 | × | × | × | × | × | × | × | × | × | × |
| 2 | × | × | × | × | × | × | × | × | × | × |
| 3 | ○ | × | × | × | × | × | × | × | × | × |
| 4 | ○ | × | × | × | × | × | × | × | × | × |
| 5 | ○ | × | × | × | × | × | × | × | × | × |
| 6 | ○ | ○ | × | × | × | × | × | × | × | × |
| 7 | ○ | ○ | × | × | × | × | × | × | × | × |
| 8 | ○ | ○ | × | × | × | × | × | × | × | × |
| 9 | ○ | ○ | ○ | × | × | × | × | × | × | × |
| 10 | ○ | ○ | ○ | × | × | × | × | × | × | × |
| 11 | ○ | ○ | ○ | × | × | × | × | × | × | × |
| 12 | ○ | ○ | ○ | ○ | × | × | × | × | × | × |
| 13 | ○ | ○ | ○ | ○ | × | × | × | × | × | × |
| 14 | ○ | ○ | ○ | ○ | × | × | × | × | × | × |
| 15 | ○ | ○ | ○ | ○ | ○ | × | × | × | × | × |
| 16 | ○ | ○ | ○ | ○ | ○ | × | × | × | × | × |
| 17 | ○ | ○ | ○ | ○ | ○ | × | × | × | × | × |
| 18 | ○ | ○ | ○ | ○ | ○ | ○ | × | × | × | × |
| 19 | ○ | ○ | ○ | ○ | ○ | ○ | × | × | × | × |
| 20 | ○ | ○ | ○ | ○ | ○ | ○ | × | × | × | × |
| 21 | ○ | ○ | ○ | ○ | ○ | ○ | ○ | × | × | × |
| 22 | ○ | ○ | ○ | ○ | ○ | ○ | ○ | × | × | × |
| 23 | ○ | ○ | ○ | ○ | ○ | ○ | ○ | × | × | × |
| 24 | ○ | ○ | ○ | ○ | ○ | ○ | ○ | ○ | × | × |
| 25 | ○ | ○ | ○ | ○ | ○ | ○ | ○ | ○ | × | × |
| 26 | ○ | ○ | ○ | ○ | ○ | ○ | ○ | ○ | × | × |
| 27 | ○ | ○ | ○ | ○ | ○ | ○ | ○ | ○ | ○ | × |
| 28 | ○ | ○ | ○ | ○ | ○ | ○ | ○ | ○ | ○ | × |
| 29 | ○ | ○ | ○ | ○ | ○ | ○ | ○ | ○ | ○ | × |
| 30 | ○ | ○ | ○ | ○ | ○ | ○ | ○ | ○ | ○ | ○ |
| 31 | ○ | ○ | ○ | ○ | ○ | ○ | ○ | ○ | ○ | ○ |

*1: Light emission period

*2: Gray scale level

○: Light emission

×: Non-light emission

FIG. 3

| *1 / *2 | SF1 | SF2 | SF3 | SF4 | SF5 | SF6 | SF7 |
|---|---|---|---|---|---|---|---|
| | 8 | 8 | 8 | 8 | 8 | 8 | 8 |
| 0 | × | × | × | × | × | × | × |
| 1 | × | × | × | × | × | × | × |
| 2 | × | × | × | × | × | × | × |
| 3 | × | × | × | × | × | × | × |
| 4 | × | × | × | × | × | × | × |
| 5 | × | × | × | × | × | × | × |
| 6 | × | × | × | × | × | × | × |
| 7 | × | × | × | × | × | × | × |
| 8 | ○ | × | × | × | × | × | × |
| 9 | ○ | × | × | × | × | × | × |
| 10 | ○ | × | × | × | × | × | × |
| 11 | ○ | × | × | × | × | × | × |
| 12 | ○ | × | × | × | × | × | × |
| 13 | ○ | × | × | × | × | × | × |
| 14 | ○ | × | × | × | × | × | × |
| 15 | ○ | × | × | × | × | × | × |
| 16 | ○ | ○ | × | × | × | × | × |
| 17 | ○ | ○ | × | × | × | × | × |
| 18 | ○ | ○ | × | × | × | × | × |
| 19 | ○ | ○ | × | × | × | × | × |
| 20 | ○ | ○ | × | × | × | × | × |
| 21 | ○ | ○ | × | × | × | × | × |
| 22 | ○ | ○ | × | × | × | × | × |
| 23 | ○ | ○ | × | × | × | × | × |
| 24 | ○ | ○ | ○ | × | × | × | × |
| 25 | ○ | ○ | ○ | × | × | × | × |
| 26 | ○ | ○ | ○ | × | × | × | × |
| 27 | ○ | ○ | ○ | × | × | × | × |
| 28 | ○ | ○ | ○ | × | × | × | × |
| 29 | ○ | ○ | ○ | × | × | × | × |
| 30 | ○ | ○ | ○ | × | × | × | × |
| 31 | ○ | ○ | ○ | × | × | × | × |
| 32 | ○ | ○ | ○ | ○ | × | × | × |
| 33 | ○ | ○ | ○ | ○ | × | × | × |
| 34 | ○ | ○ | ○ | ○ | × | × | × |
| 35 | ○ | ○ | ○ | ○ | × | × | × |
| 36 | ○ | ○ | ○ | ○ | × | × | × |
| 37 | ○ | ○ | ○ | ○ | × | × | × |
| 38 | ○ | ○ | ○ | ○ | × | × | × |
| 39 | ○ | ○ | ○ | ○ | × | × | × |
| 40 | ○ | ○ | ○ | ○ | ○ | × | × |
| 41 | ○ | ○ | ○ | ○ | ○ | × | × |
| 42 | ○ | ○ | ○ | ○ | ○ | × | × |
| 43 | ○ | ○ | ○ | ○ | ○ | × | × |
| 44 | ○ | ○ | ○ | ○ | ○ | × | × |
| 45 | ○ | ○ | ○ | ○ | ○ | × | × |
| 46 | ○ | ○ | ○ | ○ | ○ | × | × |
| 47 | ○ | ○ | ○ | ○ | ○ | × | × |
| 48 | ○ | ○ | ○ | ○ | ○ | ○ | × |
| 49 | ○ | ○ | ○ | ○ | ○ | ○ | × |
| 50 | ○ | ○ | ○ | ○ | ○ | ○ | × |
| 51 | ○ | ○ | ○ | ○ | ○ | ○ | × |
| 52 | ○ | ○ | ○ | ○ | ○ | ○ | × |
| 53 | ○ | ○ | ○ | ○ | ○ | ○ | × |
| 54 | ○ | ○ | ○ | ○ | ○ | ○ | × |
| 55 | ○ | ○ | ○ | ○ | ○ | ○ | × |
| 56 | ○ | ○ | ○ | ○ | ○ | ○ | ○ |
| 57 | ○ | ○ | ○ | ○ | ○ | ○ | ○ |
| 58 | ○ | ○ | ○ | ○ | ○ | ○ | ○ |
| 59 | ○ | ○ | ○ | ○ | ○ | ○ | ○ |
| 60 | ○ | ○ | ○ | ○ | ○ | ○ | ○ |
| 61 | ○ | ○ | ○ | ○ | ○ | ○ | ○ |
| 62 | ○ | ○ | ○ | ○ | ○ | ○ | ○ |
| 63 | ○ | ○ | ○ | ○ | ○ | ○ | ○ |

*1: Light emission period

*2: Gray scale level

○: Light emission
×: Non-light emission

FIG. 4

| X | $X^{2.2}$ | Y (1) | Y (2) |
|---|---|---|---|
| 0 | 0 | 0 | 0 |
| 1 | 1 | 0 | 0 |
| 2 | 5 | 0 | 0 |
| 3 | 11 | 0 | 1 |
| 4 | 21 | 0 | 2 |
| 5 | 34 | 1 | 4 |
| 6 | 52 | 1 | 6 |
| 7 | 72 | 2 | 9 |
| 8 | 97 | 3 | 12 |
| 9 | 126 | 4 | 16 |
| 10 | 158 | 5 | 21 |
| 11 | 195 | 6 | 26 |
| 12 | 237 | 7 | 31 |
| 13 | 282 | 9 | 37 |
| 14 | 332 | 10 | 44 |
| 15 | 387 | 12 | 51 |
| 16 | 446 | 14 | 59 |
| 17 | 509 | 16 | 67 |
| 18 | 578 | 19 | 77 |
| 19 | 651 | 21 | 86 |
| 20 | 728 | 24 | 97 |
| 21 | 811 | 26 | 108 |
| 22 | 898 | 29 | 119 |
| 23 | 990 | 32 | 132 |
| 24 | 1088 | 35 | 145 |
| 25 | 1190 | 39 | 158 |
| 26 | 1297 | 42 | 173 |
| 27 | 1409 | 46 | 188 |
| 28 | 1527 | 50 | 203 |
| 29 | 1649 | 54 | 220 |
| 30 | 1777 | 58 | 237 |
| 31 | 1910 | 62 | 254 |

X: 32 gray scale levels after gamma correction

Y (1): 64 gray scale levels before gamma correction

Y (2): 256 gray scale levels before gamma correction

FIG. 6

| X | Y | SF1 | SF2 | SF3 | SF4 | SF5 | SF6 | SF7 |
|---|---|---|---|---|---|---|---|---|
| | | 1 | 2 | 4 | 7 | 10 | 11 | 27 |
| 0 | 0 | × | × | × | × | × | × | × |
| 1 | 0 | × | × | × | × | × | × | × |
| 2 | 0 | × | × | × | × | × | × | × |
| 3 | 0 | × | × | × | × | × | × | × |
| 4 | 0 | × | × | × | × | × | × | × |
| 5 | 1 | ○ | × | × | × | × | × | × |
| 6 | 1 | ○ | × | × | × | × | × | × |
| 7 | 2 | ○ | × | × | × | × | × | × |
| 8 | 3 | ○ | ○ | × | × | × | × | × |
| 9 | 4 | ○ | ○ | × | × | × | × | × |
| 10 | 5 | ○ | ○ | × | × | × | × | × |
| 11 | 6 | ○ | ○ | × | × | × | × | × |
| 12 | 7 | ○ | ○ | ○ | × | × | × | × |
| 13 | 9 | ○ | ○ | ○ | × | × | × | × |
| 14 | 10 | ○ | ○ | ○ | × | × | × | × |
| 15 | 12 | ○ | ○ | ○ | × | × | × | × |
| 16 | 14 | ○ | ○ | ○ | ○ | × | × | × |
| 17 | 16 | ○ | ○ | ○ | ○ | × | × | × |
| 18 | 19 | ○ | ○ | ○ | ○ | × | × | × |
| 19 | 21 | ○ | ○ | ○ | ○ | × | × | × |
| 20 | 24 | ○ | ○ | ○ | ○ | ○ | × | × |
| 21 | 26 | ○ | ○ | ○ | ○ | ○ | × | × |
| 22 | 29 | ○ | ○ | ○ | ○ | ○ | × | × |
| 23 | 32 | ○ | ○ | ○ | ○ | ○ | × | × |
| 24 | 35 | ○ | ○ | ○ | ○ | ○ | ○ | × |
| 25 | 39 | ○ | ○ | ○ | ○ | ○ | ○ | × |
| 26 | 42 | ○ | ○ | ○ | ○ | ○ | ○ | × |
| 27 | 46 | ○ | ○ | ○ | ○ | ○ | ○ | × |
| 28 | 50 | ○ | ○ | ○ | ○ | ○ | ○ | ○ |
| 29 | 54 | ○ | ○ | ○ | ○ | ○ | ○ | ○ |
| 30 | 58 | ○ | ○ | ○ | ○ | ○ | ○ | ○ |
| 31 | 62 | ○ | ○ | ○ | ○ | ○ | ○ | ○ |

X: 32 gray scale levels after gamma correction

Y: 64 gray scale levels before gamma correction

○: Light emission

×: Non-light emission

DISPLAY DEVICE HAVING A PLURALITY OF SUBFRAMES AND METHOD OF DRIVING THE SAME

This application is a continuation of pending application Ser. No. 11/328,319 filed on Jan. 9, 2006.

BACKGROUND OF THE INVENTION

1. Field of the Invention

The present invention relates to a display device and a driving method thereof, and in particular to a display device which employs a time gray scale method.

2. Description of the Related Art

In recent years, a self-luminous display device having a pixel formed of light emitting elements such as a light emitting diode. As a light emitting element used for such a self-luminous display device, a light emitting diode (also referred to as an OLED (Organic Light Emitting Diode), an organic EL element, an inorganic EL element, and an electroluminescence (also referred to as an EL element) is attracting attentions and starting to be used for an EL display (an organic EL display, an inorganic EL display, or a display including an element containing organic and inorganic substances). A light emitting element such as an OLED which is a self-luminous element is advantageous in that visibility of pixels is high, a backlight is not required, response is fast, and the like as compared to a liquid crystal display. The luminance of a light emitting element is controlled by a value of a current flowing therethrough.

There are a digital gray scale method and an analog gray scale method as a driving method for controlling a light emission gray scale of such a display device. In the digital gray scale method, a light emitting element is controlled in a digital manner to be turned on and off, thereby a gray scale is expressed. In the analog gray scale method, on the other hand, there are a method for controlling light emission intensity of a light emitting element in an analog manner and a method for controlling light emission time of a light emitting element in an analog manner.

In the case of the digital gray scale method, there are only two states: light emission and no light emission. Therefore, only two gray scale levels can be expressed. In view of this, multi-level gray scale levels are expressed by using another method in combination. In that case, a time gray scale method is often used.

The time gray scale method is a method for expressing a gray scale by controlling the time and the number of light emission. That is, one frame period is divided into a plurality of subframe periods in each of which the time and the number of light emission are weighted. A gray scale is expressed by providing differences in the total amount of the weight (total number and time of light emission) between gray scales. When employing the time gray scale method, it is known that a display defect occurs which is called pseudo contour or the like, for which a countermeasures are being considered (see Patent Documents 1 to 7).

[Patent Document 1]
Japanese Patent No. 2903984
[Patent Document 2]
Japanese Patent No. 3075335
[Patent Document 3]
Japanese Patent No. 2639311
[Patent Document 4]
Japanese Patent No. 3322809
[Patent Document 5]
Japanese Patent Laid-Open No. hei 10-307561

[Patent Document 6]
Japanese Patent No. 3585369
[Patent Document 7]
Japanese Patent No. 3489884

SUMMARY OF THE INVENTION

In this manner, various methods for suppressing pseudo contour have been suggested, however, none of them have provided a sufficient effect for reducing pseudo contour.

For example, 127 gray scale levels are expressed by a pixel A and 128 gray scale levels are expressed by a pixel B adjacent to the pixel A. FIG. 21 shows light emission and non-light emission of the pixels in each subframe. If a visual line 2101 keeps watching at only the pixel A or the pixel B without moving, a pseudo contour does not occur (see Patent Document 2). This is because eyes sense brightness by the sum of the brightness of portions where the visual line 2102 passes. Accordingly, the eyes sense 127 gray scale levels (=1+2+4+8+16+32+32+32) in the pixel A and 128 gray scale levels (=32+32+32+32) in the pixel B. That is, the eyes sense the correct gray scale levels.

On the other hand, FIG. 22 shows the case where the visual line moves from the pixel A to the pixel B or from the pixel B to the pixel A. In this case, the eyes sense 96 gray scale levels (=32+32+32) at one time and 159 gray scale levels (=1+2+4+8+16+32+32+32+32) at the other time depending on the movement of a visual line 2201. The gray scale levels are sensed such as 96 and 159 while 127 gray scale levels and 128 gray scale levels are supposed to be sensed originally, thus a pseudo contour is generated.

Further, a certain pixel A expresses 31 gray scale levels while a pixel B adjacent thereto expresses 32 gray scale levels, for example. FIG. 23 shows light emission and non-light emission of the pixels in each subframe. If a visual line 2301 keeps watching at only the pixel A or the pixel B without moving, a pseudo contour does not occur. This is because eyes sense brightness by the sum of the brightness of portions where the visual line 2301 passes (see Patent Document 3). Accordingly, the eyes sense 31 gray scale levels (=16+4+4+4+1+1+1) in the pixel A and 32 gray scale levels (=16+16) in the pixel B. That is, the eyes sense the correct gray scale levels.

On the other hand, for example, the visual line moves from the pixel A to the pixel B, or from the pixel B to the pixel A, which is shown in FIG. 24. In this case, the eyes sense 16 gray scale levels (=16) at one time and 47 (=16+16+4+4+4+1+1+1) gray scale levels at the other time depending on the movement of a visual line 2401. The gray scale levels are sensed such as 16 and 47 while 31 gray scale levels and 32 gray scale levels are supposed to be sensed originally, thus pseudo contour is generated.

The invention provides a display device which is formed of the less number of subframes and which can reduce pseudo contour, and a driving method thereof.

According to the invention, each weight of subframe (the period, number, and the like of light emission) is sequentially added to express the gray scale in an intermediate gray scale level expressed by a binary value. Accordingly, it can be prevented that pseudo contour is generated.

Further, in order to express a multi-level gray scale, another method (an area gray scale method, a dither diffusion method, or an error diffusion method) is employed in combination.

Further, in a pixel configuration, a signal stored in a pixel is erased by using a diode. A light emitting element becomes a non-light emission state only by turning on the diode, therefore, less power consumption can be achieved.

The invention achieves the aforementioned objects by expressing gray scales in accordance with such methods.

The invention is characterized in that a plurality of pixels each of which includes a selecting transistor, a driving transistor, and an erasing diode are provided and one frame is divided into a plurality of subframes which are weighted so as to be approximately equal with respect to light emission to express a gray scale. Here, weight (with respect to light emission) means a length of a light emission time for expressing a gray scale. Additionally, "approximately equally weighting" indicates that a weighted frequency of light emission or weighted light emission period or the like in each of subframes may have a difference which cannot be recognized by human eyes. Although a range of the difference differs depending on the number of bits used for displaying and a gray scale level of displaying, for example, even if each of subframes has a difference of 3 gray scale levels, "approximately equally weighting" is deemed to be performed in the case where 64 gray scales are used for displaying.

The invention provides a driving method of a display device which includes a plurality of pixels each of which includes a selecting transistor, a driving transistor, and an erasing diode. One frame is divided into a plurality of subframes which are weighted so as to be gradually larger with respect to light emission to express a gray scale. As the number of gray scale levels becomes larger, subframes for light emission are accumulated.

According to the invention, the weights of the subframes are controlled by the erasing diode in the aforementioned configuration.

According to the invention, the display device is an EL display device in the aforementioned configuration.

A transistor used for the invention may be a thin film transistor (TFT) using a non-single crystalline semiconductor film represented by amorphous silicon or polycrystalline silicon, a MOS transistor formed by using a semiconductor substrate or an SOI substrate, a junction transistor, a bipolar transistor, a transistor using an organic semiconductor or a carbon nanotube, or other transistors. Furthermore, a substrate over which a transistor is mounted is not exclusively limited to a certain type. It may be a single crystalline substrate, an SOI substrate, a glass substrate, a plastic substrate, and the like.

In the invention, a connection means an electrical connection. Therefore, another element (for example, another element, a switch, or the like) capable of electrical connection may be provided in addition to a predetermined connection in the disclosed configuration of the invention.

According to the invention, pseudo contour can be reduced. Therefore, display quality can be improved and a clear image can be displayed. Moreover, power consumption can be reduced.

BRIEF DESCRIPTION OF THE DRAWINGS

FIG. 1 is a diagram showing a configuration of a driving method of a display device of the invention.

FIG. 2 is a diagram showing a configuration of a driving method of a display device of the invention.

FIG. 3 is a diagram showing a configuration of a driving method of a display device of the invention.

FIG. 4 is a diagram showing a configuration of a driving method of a display device of the invention.

FIG. 6 is a diagram showing a configuration of a driving method of a display device of the invention.

DETAILED DESCRIPTION OF THE INVENTION

Figure 5:
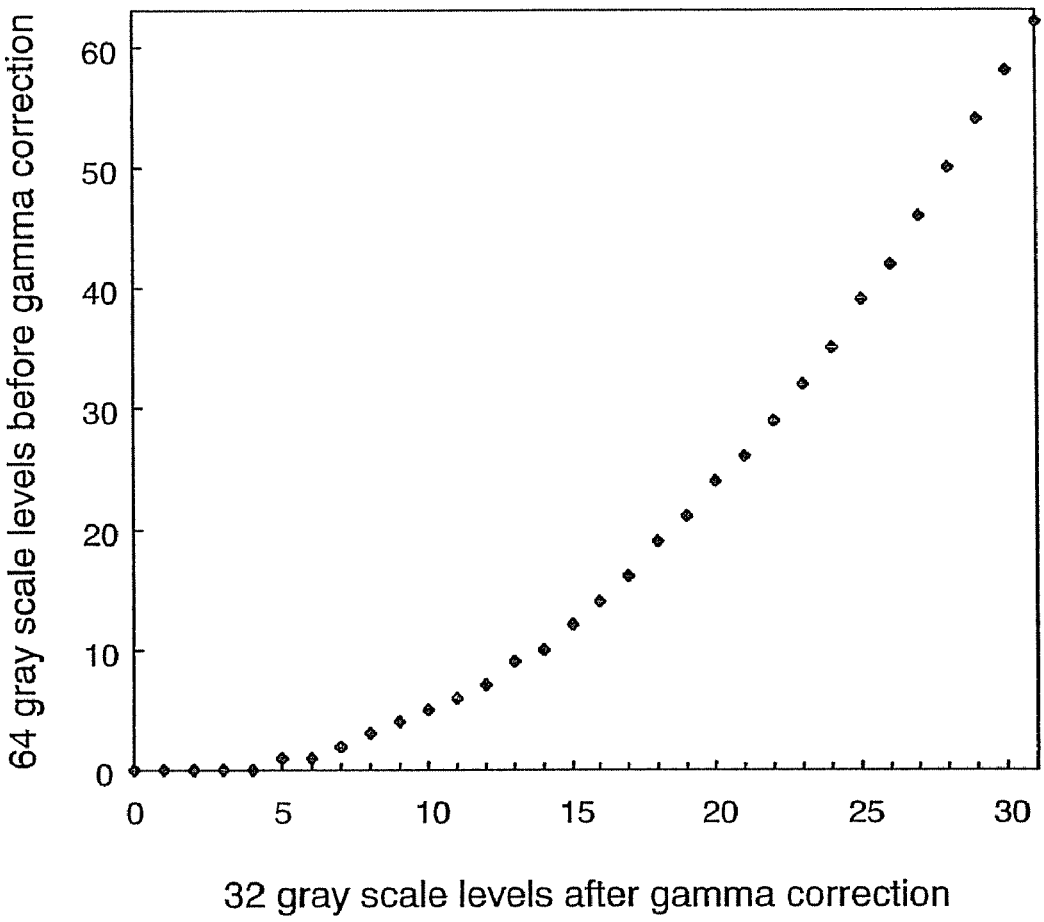
FIG. 5 is a diagram showing a configuration of a driving method of a display device of the invention.

Although the invention will be fully described by way of embodiment modes with reference to the accompanying drawings, it is to be understood that various changes and modifications will be apparent to those skilled in the art. Therefore, unless such changes and modifications depart from the scope of the invention, they should be construed as being included therein.

Embodiment Mode 1

Here, for example, 5-bit gray scale is expressed. That is, description is made on the case of 32 gray scale levels.

According to the invention, gray scale is expressed by sequentially adding light emission period of each subframe (or the number of light emission in a certain time). That is, the higher the gray scale is, the light emitting element emits light in more subframes. Therefore, the subframe in a light emission state in the low gray scale level is also in light emission state in the high gray scale level. Such a gray scale method is referred to as a superimpose time gray scale method. By the superimpose time gray scale method, whole gray scale levels are expressed.

Next, description is made on a method for selecting a subframe in each gray scale level, that is, whether each subframe emits light or not in each gray scale level. FIG. 1 shows a method for selecting subframes in the case where one frame is formed of seven subframes. Accordingly, 3-bit, namely eight gray scale levels can be expressed. Each length of all light emission periods is four. Here, "one" of the gray scale level and "one" of the length of light emission period correspond to each other.

It is to be noted that the length of the light emission period of each subframe (or the number of light emission, namely the weight) is all four, however, the invention is not limited to this. The length of the light emission period (or the number of light emission at a certain time, that is the weight) may be different depending on the subframe.

Here, description is made on how to see FIG. 1. The light emitting element emits light in a subframe marked "O", and emits no light in a subframe marked "X". Then, a gray scale of each gray scale level is expressed by selecting a subframe for light emission. For example, in the case of 0 gray scale level, SF1 to SF7 are all in the non-light emission state. In the case of 1 gray scale level, SF1 to SF7 are in the non-light emission state. In the case of 4 gray scale levels, SF2 to SF7 are in the non-light emission state and SF1 is in the light emission state. In the case of 5 gray scale levels, SF2 to SF7 are in the non-light emission state and SF1 is in the light emission state. In the case of 8 gray scale levels, SF3 to SF7 are in the non-light emission state and SF1 and SF2 are in the light emission state.

In this manner, by sequentially adding light emission periods of each subframe, a gray scale is expressed. That is, the higher the gray scale level is, the more subframes are in the light emission state. Therefore, SF1 is in the light emission state in the case of 4 gray scale levels or higher, SF2 is in the light emission state in the case of 8 gray scale levels or higher, and SF3 is in the light emission state in the case of 12 gray scale levels or higher. The aforementioned can be similarly applied to SF4 to SF7. That is, a subframe which is in the light emission state in a lower gray scale level is also in the light emission state in a higher gray scale level.

With such a driving method, pseudo contour can be reduced. This is because subframes which are in the light emission state at a gray scale level lower than a certain gray scale level are all in the light emission state. Accordingly, it can be prevented that incorrect brightness is sensed at a changing point of gray scale levels even when the visual line moves.

In the case of FIG. 1, however, only up to 8 gray scale levels can be expressed as the number of subframes is 7. In view of this, another method is employed in combination to express a multi-level gray scale. Three major methods are as follows.

As a first example, the area gray scale method is suggested. In this method, a pixel is divided into a plurality of subpixels. Then, light emission areas of the subpixels are changed. For example, the divided areas are powers of 2 such as 1:2:4:8:. . . . . Then, a gray scale is expressed by selecting a subpixel for light emission.

As a second example, an image processing technique is suggested. For example, a dither diffusion method or an error diffusion method is used. Accordingly, a multi-level gray scale can be expressed.

As a third example, a method for expressing one gray scale using a plurality of subframes is suggested. For example, 8 gray scale levels are expressed by even-numbered frames and 10 gray scale levels are expressed by odd-numbered frames. Then, 9 gray scale levels can be expressed as human eyes sense the averaged luminance.

It is to be noted that each of the aforementioned first to third examples may be employed in combination.

Next, FIG. 2 shows the case of expressing a gray scale using 10 subframes. Here, 11 gray scale levels can be expressed since 10 subframes are used. To express a multi-level gray scale, the methods described as the first to third examples may be employed.

More gray scale levels can be expressed by the time gray scale method in the case of FIG. 2 as compared to FIG. 1, therefore, a gray scale can be expressed more smoothly.

Next, a 6-bit gray scale is expressed. FIG. 3 shows a method for selecting a subframe in the case where 7 subframes are provided.

Here, as 7 subframes are used, 8 gray scale levels can be expressed. The length of a light emission period in the subframe is 8. To express a multi-level gray scale, the methods described as the first to third examples may be employed.

In this manner, with N subframes, N+1 gray scale levels can be expressed in a time gray scale portion.

It is to be noted that subframes can be selected by a plurality of methods in the case of expressing one gray scale. Therefore, a method for selecting a subframe in a certain gray scale level may be changed according to time or a place. That is, the method for selecting a subframe may be changed according to time or pixels, or according to both time and pixels.

In the case of expressing a certain gray scale, for example, a method for selecting a subframe may be changed between when the number of frames is an odd number and when it is an even number. Further, in the case of expressing a certain gray scale, a method for selecting a subframe may be changed between when odd row pixels perform display and when even row pixels perform display. Alternatively, a method for selecting subframes may be changed between when even column pixels perform display and when odd column pixels perform display.

Heretofore described is the case where the light emission periods are increased in a linear shape in proportion to the number of gray scale levels. Next, description is made on the case where gamma correction is performed. With gamma correction, the light emission periods are increased in a non-linear shape when the number of gray scale levels is increased. Even when the luminance is increased in a linear shape in proportion to the gray scale levels, human eyes do not sense that the brightness increases proportionately. The higher the luminance becomes, the less the human eyes sense the difference in brightness. Accordingly, a light emission period is required to be longer as the number of gray scale levels increases so that human eyes can sense the difference in brightness. That is, gamma correction is required to be performed.

The simplest method is to set so that display can be performed with more bits (gray scale levels) than the number of bits (gray scale levels) which is actually expressed. For example, when 6-bit (64 gray scale levels) display is performed, 8-bit (256 gray scale levels) display can be performed actually. In the case of performing display actually, 6-bit (64 gray scale levels) display is performed so that the luminance in accordance with the gray scale level increases in a non-linear shape. Accordingly, gamma correction can be achieved.

In the case where the luminance is Y, the number of gray scale levels is X, a gamma value is $\gamma$, and a proportionality factor is A, $Y=AX^{\gamma}$ is satisfied. It is generally said to be the best for human eyes when $\gamma=2.2$ is satisfied. Accordingly, $Y=AX^{2.2}$ is to be satisfied.

It is to be noted that the gamma value is not limited to 2.2 and may be a value optimal for human eyes. Therefore, the gamma value may be 1.7 to 2.7, and preferably about 2.2.

For example, FIG. 4 shows a correspondence table for 32 gray scale levels after the gamma correction, 64 gray scale levels before the gamma correction, and 256 gray scale levels before the gamma correction. In the case where display of 64 gray scale levels or 256 gray scale levels is performed before the gamma correction and actually display of 32 gray scale levels is performed after the gamma correction, the correspondence table of FIG. 4 is to be referred. The number of gray scale levels after the gamma correction of the 32 gray scale levels is X. If $\gamma=2.2$ is satisfied, $X^{2.2}$ can be obtained. Here, $X^{2.2}$ in the case of 31 gray scale levels is 1910. Therefore, the number of gray scale levels before the gamma correction of the 64 gray scale levels can be obtained by multiplying $X^{2.2}$ by 64 and dividing it by 1910 which corresponds to $X^{2.2}$ for the 31 gray scale levels. Similarly, the number of gray scale levels before the gamma correction of the 256 gray scale levels can be obtained by multiplying $X^{2.2}$ by 256 and dividing it by 1910 which corresponds to $X^{2.2}$ for the 31 gray scale levels. Similar operations can be applied to various gray scale levels.

FIG. 5 shows a graph of 32 gray scale levels after gamma correction and 64 gray scale levels before gamma correction. As shown in FIG. 5, a value of the 64 gray scale levels before the gamma correction, that is luminance thereof increases in a non-linear shape as the number of gray scale levels of the 32 gray scale levels after the gamma correction increases. Accordingly, a display which looks smooth to human eyes can be performed.

In the case of performing gamma correction, a length of a light emission period of each subframe is not necessarily the same, since the number of gray scale levels and luminance are in relation of a non-linear shape. Therefore, it is preferable to select the length of the light emission period of each subframe so as to satisfy a formula $Y=AX^{\gamma}$.

For example, FIG. 6 shows a length of each subframe period and a method for selecting a subframe with respect to the 32 gray scale levels after the gamma correction and the corresponding 64 gray scale levels before the gamma correction. A subframe SF1 has a light emission period 1, a subframe SF2 has a light emission period 2, a subframe SF3 has a light emission period 4, a subframe SF4 has a light emission period 7, a subframe SF5 has a light emission period 10, a subframe SF6 has a light emission period 11, and a subframe SF7 corresponds to a light emission period 27. In this manner, the length of the subframe to be selected becomes longer as the number of gray scale levels increases. Accordingly, gamma correction can be performed more appropriately. It is to be noted that the length of the light emission period of each subframe is not limited to this and may be appropriately adjusted in accordance with the number of subframes and the like.

Described here is the case of the 32 gray scale levels after the gamma correction, however, the invention is not limited to this. A correspondence table of another gray scale level before and after gamma correction can also be appropriately formed.

Further, the number of bits (for example, p-bit when p is an integer here) to be set for display and the number of bits (for example, q-bit when q is an integer here) to be expressed after gamma correction are not limited to the aforementioned. In the case of performing a display after the gamma correction, the number of bits p is preferably as large as possible for expressing the gray scale smoothly. However, if the number of bits p is too large, there is a problem in that too many subframes are formed, and the like. Therefore, it is preferable that the bit numbers q and p be in the relation of $q+2 \leqq p \leqq q+5$. Accordingly, a gray scale can be expressed smoothly without increasing the number of subframes so much.

It is to be noted that a normal frame frequency is 60 Hz, however, the invention is not limited to this. Pseudo contour may be reduced by further increasing the frequency. For example, a frequency of about 120 Hz which is twice the normal frequency may be employed as well.

Next, description is made on an example of a timing chart. The method for selecting a subframe shown in FIG. 1 is employed as an example, however, the invention is not limited to this and other selecting methods, gray scale levels, or the like can easily be applied.

Figure 7:
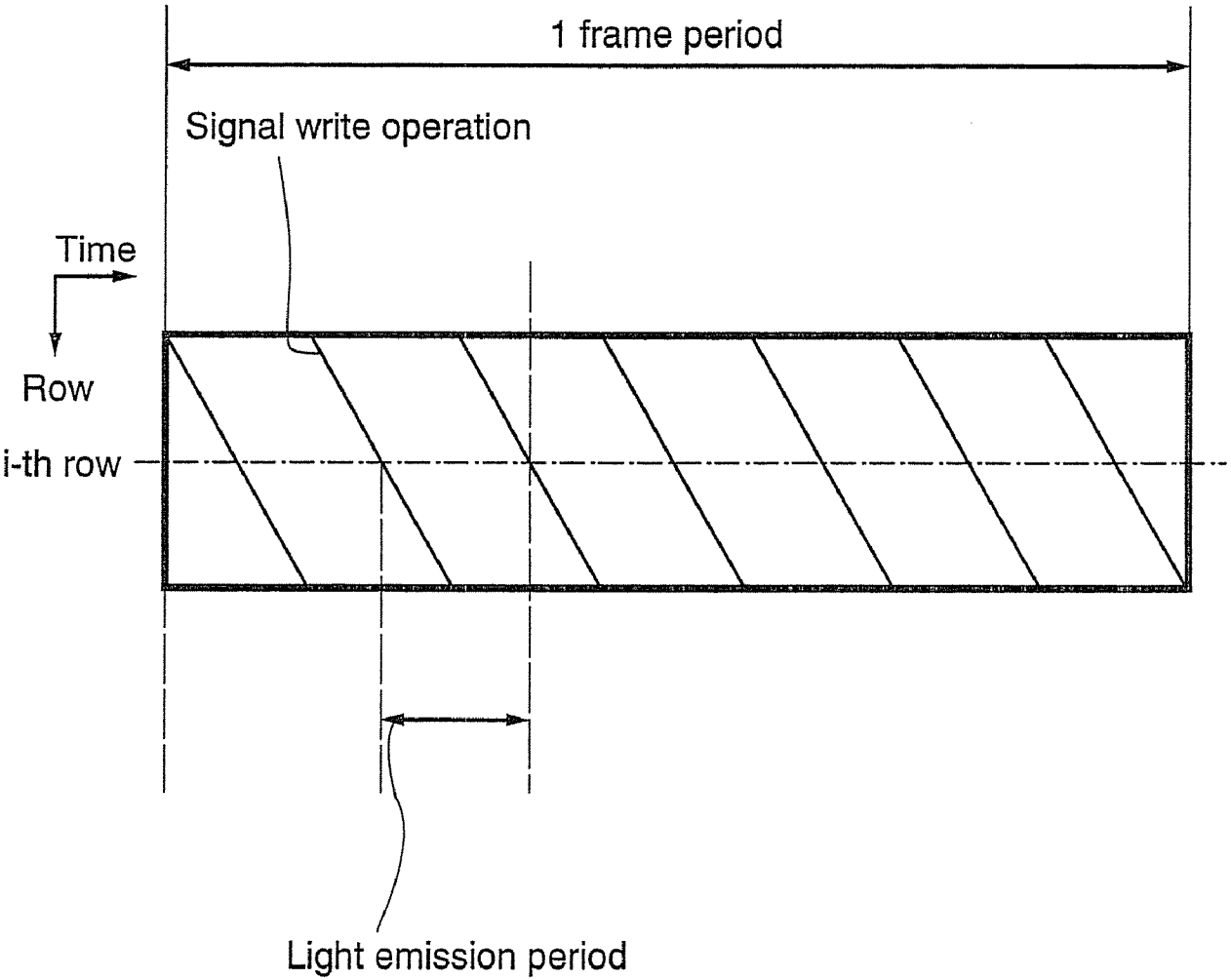
FIG. 7 is a diagram showing a configuration of a driving method of a display device of the invention.

First, FIG. 7 shows a timing chart. In each row, a light emission period 701 starts right after a signal write operation.

In a certain row, after signals are written and the predetermined light emission period 701 ends, a signal write operation in a next subframe starts. By repeating this operation, the length of the light emission periods 701 is arranged like 4, 4, 4, 4, 4, 4, 4.

Accordingly, many subframes can be arranged in one frame even when a signal write operation is performed at a low rate.

The luminance of the entire screen may be controlled by controlling a duty ratio (a ratio of a light emission period in one frame period) in some cases. In such a case, a non-light emission state is required to be forcibly made. As one of the methods, a signal stored in a pixel is erased.

Next, FIG. 7 shows a timing chart in the case of performing an operation to erase the signal stored in a pixel. In each row, a signal write operation is performed and a signal stored in a pixel is erased before a next signal write operation starts. Accordingly, a length of a light emission period can easily be controlled. Thus, a duty ratio can be freely changed.

Further, in the case where a length of a light emission period is different in each subframe when performing gamma correction and the like, the length of the light emission period can be controlled by changing a timing to erase the signal per each subframe.

Figure 8:
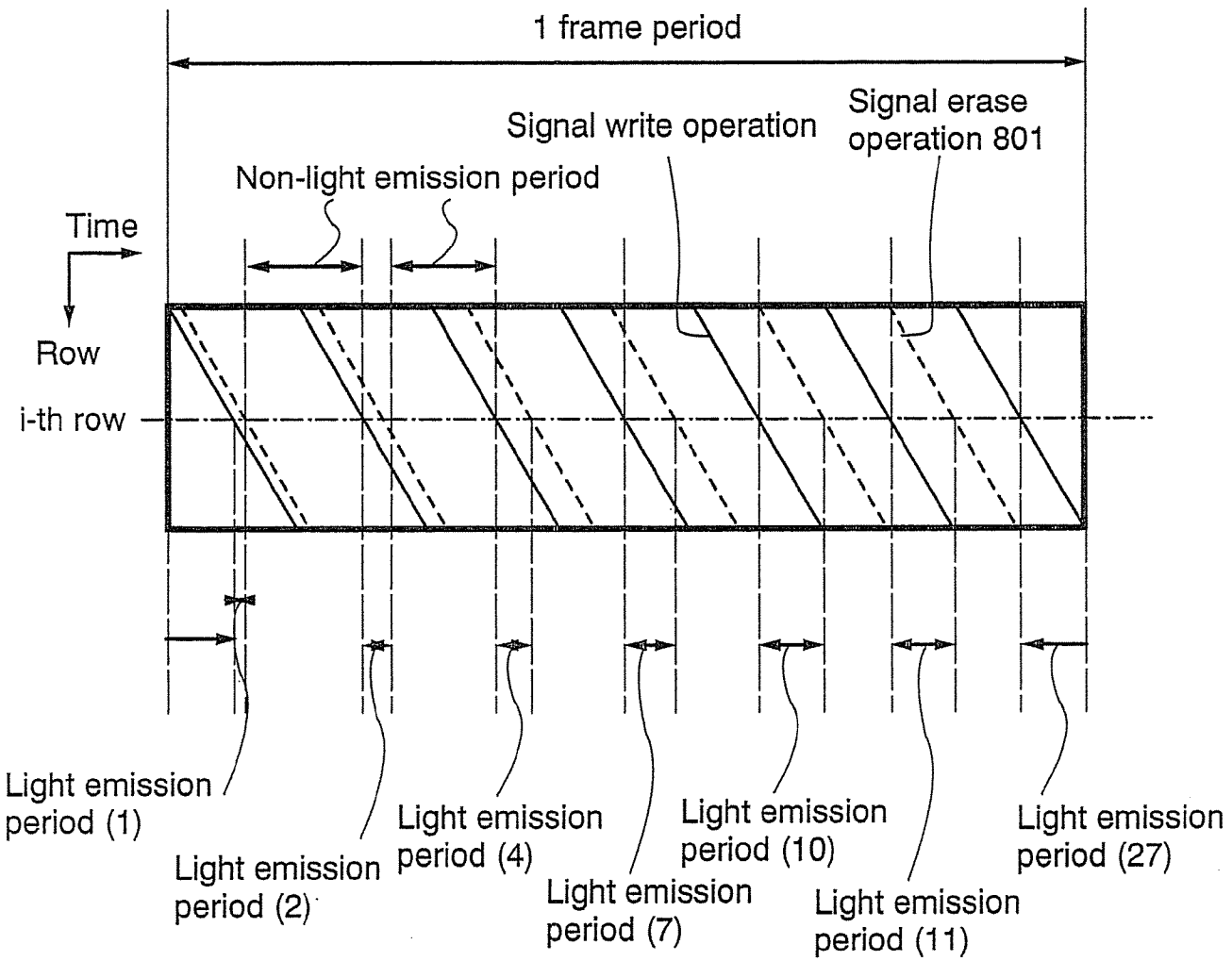
FIG. 8 is a diagram showing a configuration of a driving method of a display device of the invention.

For example, FIG. 8 shows a timing chart in the case of the method for selecting a light emission period shown in FIG. 6 is employed. In this manner, by changing a timing of a signal erase operation 801 per each subframe, a length of a light emission period can be appropriately adjusted.

Figure 9:
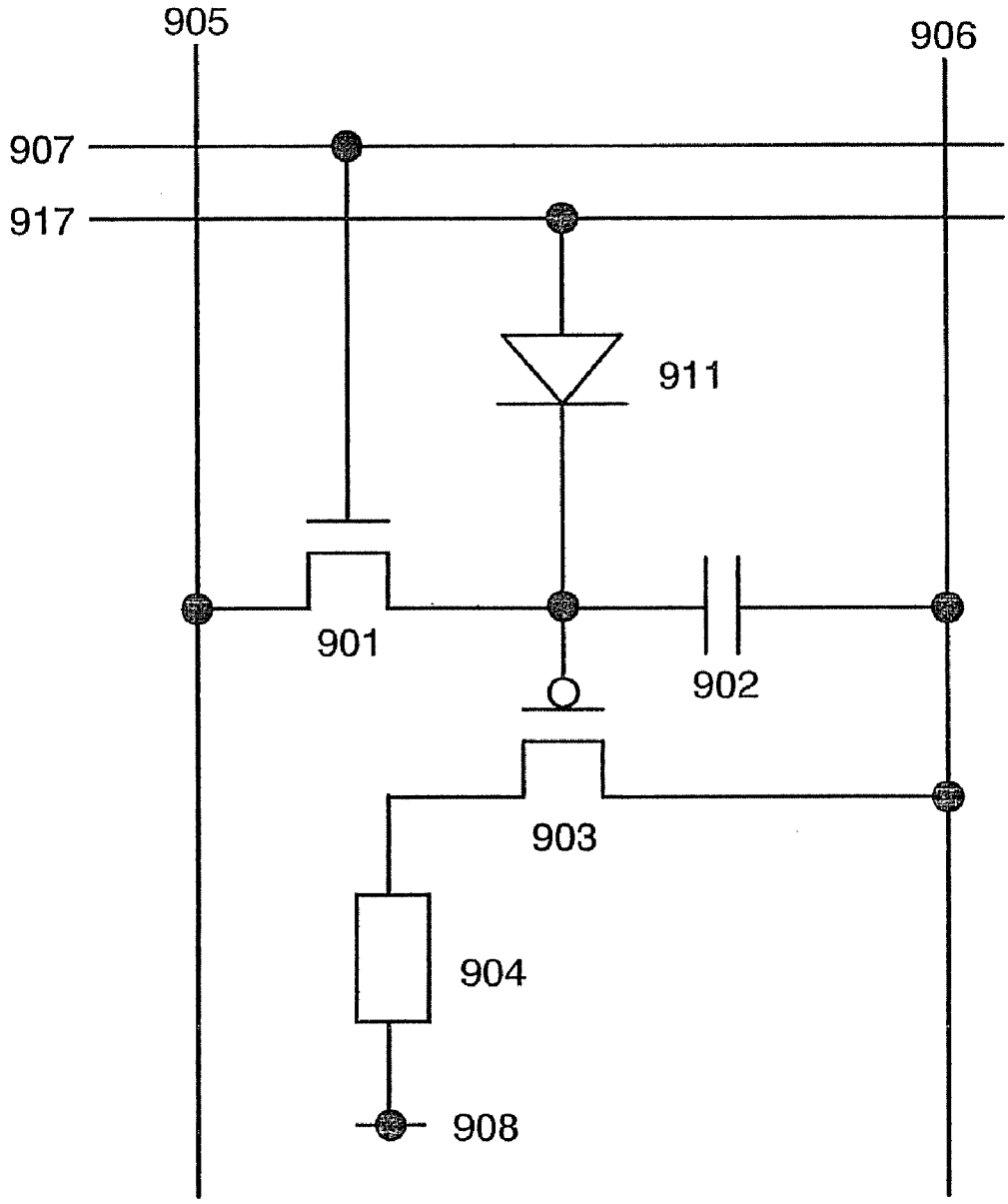
FIG. 9 is a diagram showing a configuration of a display device of the invention.

FIG. 9 shows a pixel configuration example in the case of forcibly turning off a driving transistor. A selecting transistor 901, a driving transistor 903, an erasing diode 911, and a display element 904 are arranged. A source and a drain of the selecting transistor 901 are connected to a signal line 905 and a gate of the driving transistor 903 respectively. A gate of the selecting transistor 901 is connected to a first gate line 907. A source and a drain of the driving transistor 903 are connected to a power source line 906 and the display element 904 respectively. The erasing diode 911 is connected to a gate of the driving transistor 903 and a second gate line 917.

A capacitor 902 functions to hold a gate potential of the driving transistor 903. Therefore, the capacitor 902 is connected between the gate of the driving transistor 903 and the power source line 906, however, the invention is not limited to this. The capacitor 902 is only required to be provided so as to hold the gate potential of the driving transistor 903. Further, in the case where the gate potential of the driving transistor 903 can be held by using gate capacitance of the driving transistor 903 and the like, the capacitor 902 may be omitted.

As an operation, the first gate line 907 is selected to turn on the selecting transistor 901, thereby a signal is inputted from the signal line 905 to the capacitor 902. Then, a current flowing through the driving transistor 903 is controlled in accordance with the signal, thereby a current flows from the first power source line 906 to a second power source line 908 through the display element 904.

In the case of erasing a signal, the second gate line 917 is selected (here, a high potential is applied) to turn on the erasing diode 911, thereby a current flows from the second gate line 917 to the gate of the driving transistor 903. As a result, the driving transistor 903 is turned off. Then, a current does not flow from the first power source line 906 to the second power source line 908 through the display element 904. As a result, a non-light emission period can be provided, thereby a length of a light emission period can be freely adjusted.

At this time, by applying a sufficiently high potential to the second gate line 917, the driving transistor 903 can be normally turned off even when a threshold voltage of the driving transistor 903 is an abnormal value (for example, a threshold voltage of a P-channel transistor is a positive value). Further, a non-light emission period can be provided only by controlling only one second gate line 917, thereby power consumption can be small.

In the case of holding a signal, the second gate line 917 is in a non-selection state (here, a low potential is applied). Then, the erasing diode 911 is turned off, and thus the gate potential of the driving transistor 903 is held.

It is to be noted that the erasing diode 911 may be any elements having a rectifying property. A PN diode, a PIN diode, a Schottky diode, or a Zener diode may be used.

Figure 10:
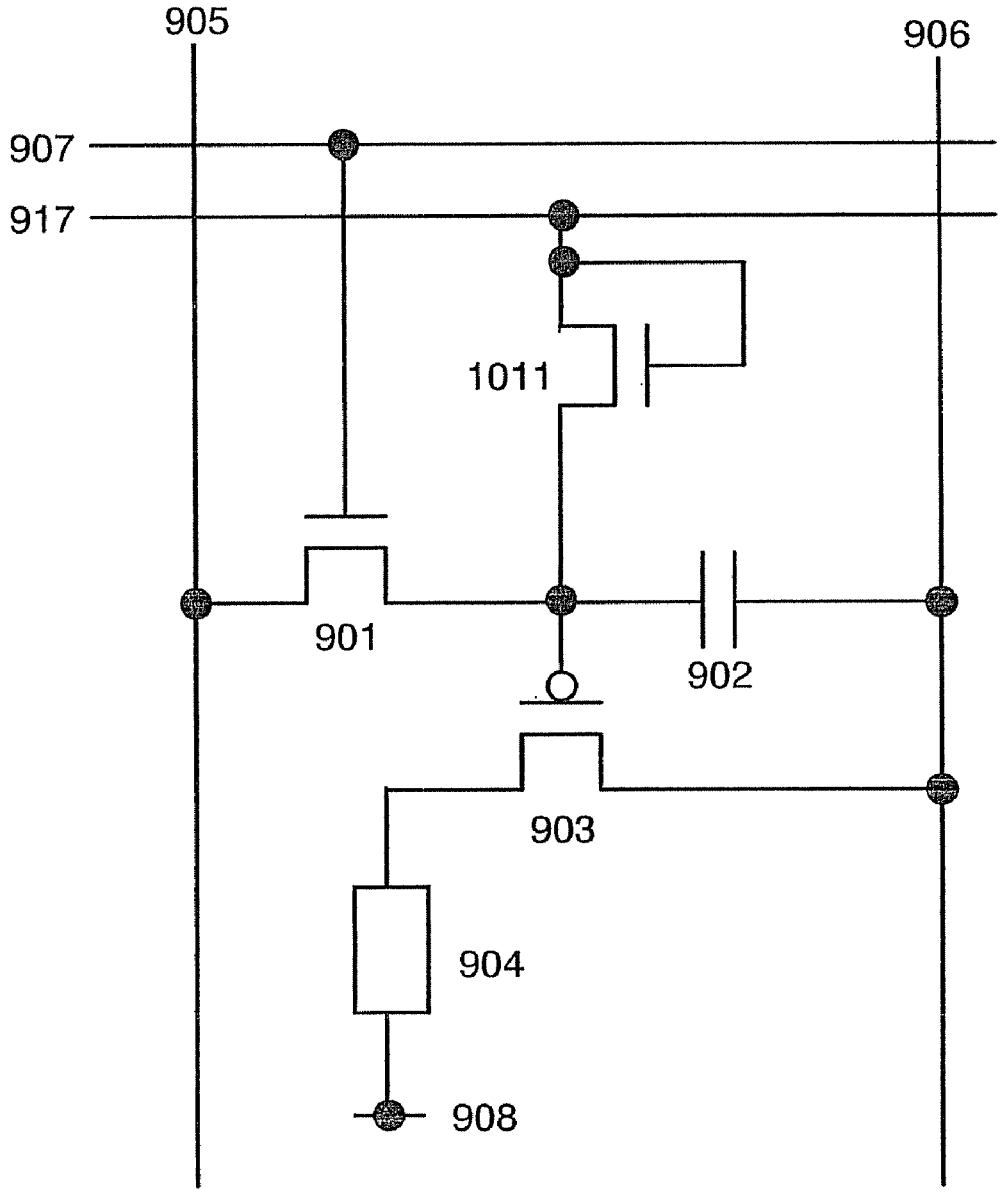
FIG. 10 is a diagram showing a configuration of a display device of the invention.

Further, a diode-connected transistor (a gate and a drain thereof are connected) may be used as a diode. FIG. 10 shows a circuit diagram in that case. A transistor 1011 which is diode-connected is used as the erasing diode 911. Here, an N-channel transistor is used, however, the invention is not limited to this and a P-channel transistor may be used as well.

In this manner, in the case of providing a non-light emission period, a current is controlled so as not to be supplied to a display element to provide a non-light emission state forcibly. Therefore, a switch is provided somewhere in a path of a current flowing from the first power source line 906 to the second power source line 908 through the display element 904 and controlled to be on/off to provide a non-light emission period. Alternatively, a gate-source voltage of the driving transistor 903 is controlled so as to forcibly turn off the driving transistor.

It is to be noted that an order that the subframes appear may change in accordance with time. For example, the order that the subframes appear may change between a first frame and a second frame. Further, the order that the subframes appear may change in accordance with a place. For example, the order that the subframes appear may change between a pixel A and a pixel B. Further, the order that the subframes appear may change in accordance with time and a place in combination.

Further, in FIG. 1, for example, the order that the subframes appear may be arranged sequentially from SF1 to SF7 or randomly.

In this embodiment mode, the light emission period, the signal write period, and the non-light emission period are provided in one frame, however, the invention is not limited to this. Other operation periods may be arranged as well. For example, a period to change a voltage to be applied to a display element so as to be opposite polarity to normal polarity, that is, a reverse bias period may be provided. By providing a reverse bias period, reliability of the display element may be improved in some cases.

Embodiment Mode 2

Hereinafter described in this embodiment mode are configurations of a display device, a signal line driver circuit, a gate line driver circuit, and the like, and operations thereof.

Figure 11:
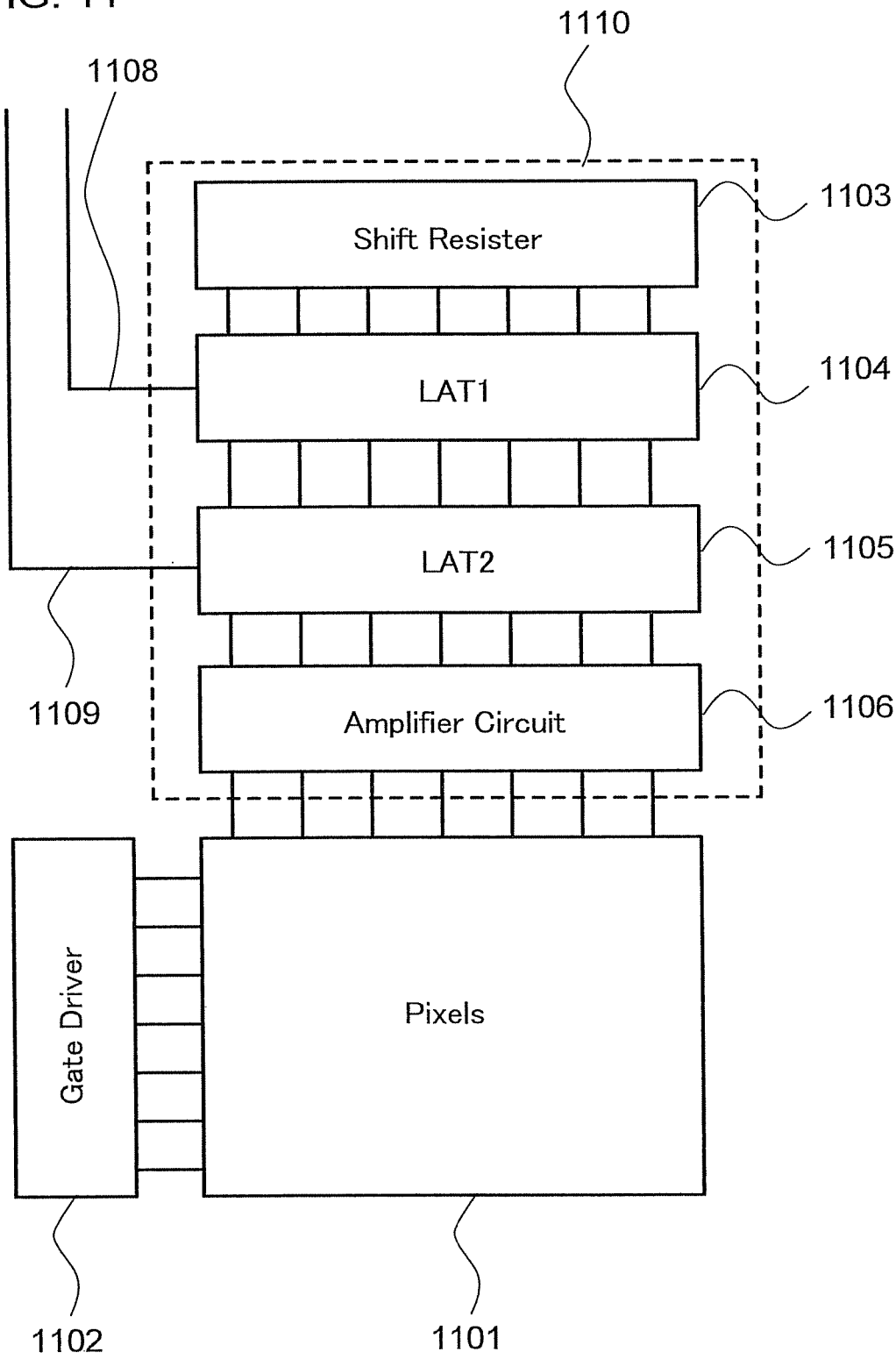
FIG. 11 is a diagram showing a configuration of a display device of the invention.

A display device includes a pixel portion 1101, a gate line driver circuit 1102, and a signal line driver circuit 1110 as shown in FIG. 11. The gate line driver circuit 1102 sequentially outputs selection signals to the pixel portion 1101. The gate line driver circuit 1102 is formed of a shift register, a buffer circuit, and the like.

Besides, the gate line driver circuit 1102 often includes a level shifter circuit, a pulse width control circuit and the like. The shift register outputs pulses for sequential selection. The signal line driver circuit 1110 sequentially outputs video signals to the pixel portion 1101. The shift register 1103 outputs pulses for sequential selection. The pixel portion 1101 displays an image by controlling a state of light in accordance with the video signals. The video signals inputted from the signal line driver circuit 1110 to the pixel portion 1101 are often voltage. That is, a display element arranged in each pixel or an element which controls the display element change their states in accordance with video signals (voltage) inputted form the signal line driver circuit 1110. The display element arranged in the pixel is, for example, an EL element, an element used in an FED (Field Emission Display), liquid crystals, a DMD (Digital Micromirror Device) or the like.

It is to be noted that a plurality of the gate line driver circuits 1102 and the signal line driver circuits 1110 may be provided as well.

The configuration of the signal line driver circuit 1110 can be divided into a plurality of portions. As a brief example, the signal line driver circuit 1110 can be divided into the shift register 1103, a first latch circuit (LAT1) 1104, a second latch circuit (LAT2) 1105, and an amplifier circuit 1106. The amplifier circuit 1106 may have a function to convert a digital signal into an analog signal, a function to perform gamma correction, and the like.

Further, a pixel includes a display element such as an EL element. A pixel may include a circuit to output a current (video signal) to the display element, that is, a current source circuit.

Then, an operation of the signal line driver circuit 1110 is briefly described. The shift register 1103 is inputted with a clock signal (S-CLK), a start pulse (SP), and a clock inverted signal (S-CLKb) and sequentially outputs sampling pulses in accordance with the timing of these signals.

The sampling pulses outputted from the shift register 1103 are inputted to the first latch circuit (LAT1) 1104. The first latch circuit (LAT1) 1104 is inputted with video signals from a video signal line 1108, and then the video signals are held in each column in accordance with a timing at which the sampling pulses are inputted.

When the video signals are held up to the last column in the first latch circuit (LAT1) 1104, a latch pulse is inputted from a latch control line 1109 in a horizontal flyback period, and then the video signals held in the first latch circuit (LAT1) 1104 are transferred to a second latch circuit (LAT2) 1105 all at once. After that, the video signals held in the second latch circuit (LAT2) 1105 are inputted to the amplifier circuit 1106 one row at a time. Then, the signals outputted from the amplifier circuit 1106 are inputted to the pixel portion 1101.

While the video signals held in the second latch circuit (LAT2) 1105 are inputted to the amplifier circuit 1106 and then to the pixel portion 1101, sampling pulses are outputted again from the shift register 1103. That is, two operations are performed at the same time. Accordingly, a line sequential drive can be performed. Hereafter this operation is repeated.

It is to be noted that a signal line driver circuit or a portion thereof (a current source circuit, an amplifier circuit, and the like) may not exist over the same substrate as the pixel portion 1101, and may be formed using, for example, an external IC chip.

Figure 12:
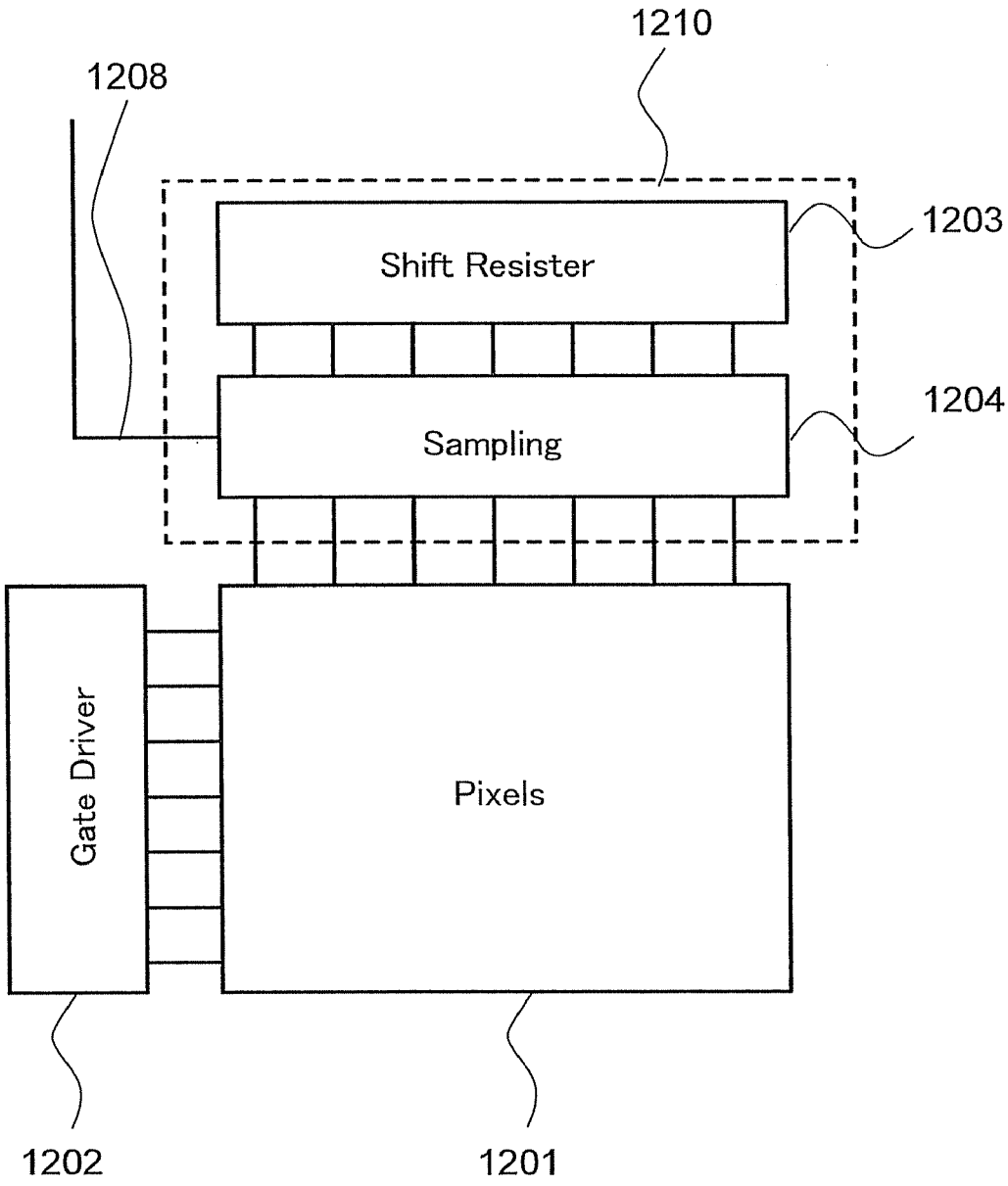
FIG. 12 is a diagram showing a configuration of a display device of the invention.

It is to be noted that the configurations of the signal line driver circuit, the gate line driver circuit, and the like are not limited to FIG. 11. For example, signals are supplied to a pixel by a dot sequential drive in some cases. FIG. 12 shows an example of a signal line driver circuit 1210 in that case. Sampling pulses are outputted from a shift register 1203 to a sampling circuit 1204. Video signals are inputted from a video signal line 1208 and then outputted to a pixel portion 1201 in accordance with the sampling pulses. Then, signals are sequentially inputted to pixels in a row which is selected by a gate line driver circuit 1202.

It is to be noted that, as described before, a transistor used in the invention may be any type of transistor and may be formed over any substrates. Therefore, the circuits shown in FIGS. 11 and 12 may be all formed over a glass substrate, a plastic substrate, a single crystalline substrate, an SOI substrate, or any other substrates. Alternatively, a portion of the circuit shown in FIG. 11 or 12 may be formed over a certain substrate and another portion thereof may be formed over another substrate. That is, all of the circuit shown in FIG. 11 or 12 is not required to be formed over the same substrate. For example, in FIG. 11, the pixel portion 1101 and the gate line driver circuit 1102 are formed using TFTs over a glass substrate, the signal line driver circuit 1110 (or a portion thereof) is formed over a single crystalline substrate, and an IC chip thereof may be provided over a glass substrate by a COG (Chip On Glass) method. Alternatively, the IC chip may be connected to the glass substrate by a TAB (Tape Auto Bonding) method or using a printed substrate.

It is to be noted that the description made in this embodiment mode corresponds to the one utilizing Embodiment Mode 1. Therefore, the description made in Embodiment Mode 1 can be applied to this embodiment mode as well.

Embodiment Mode 3

Figure 13:
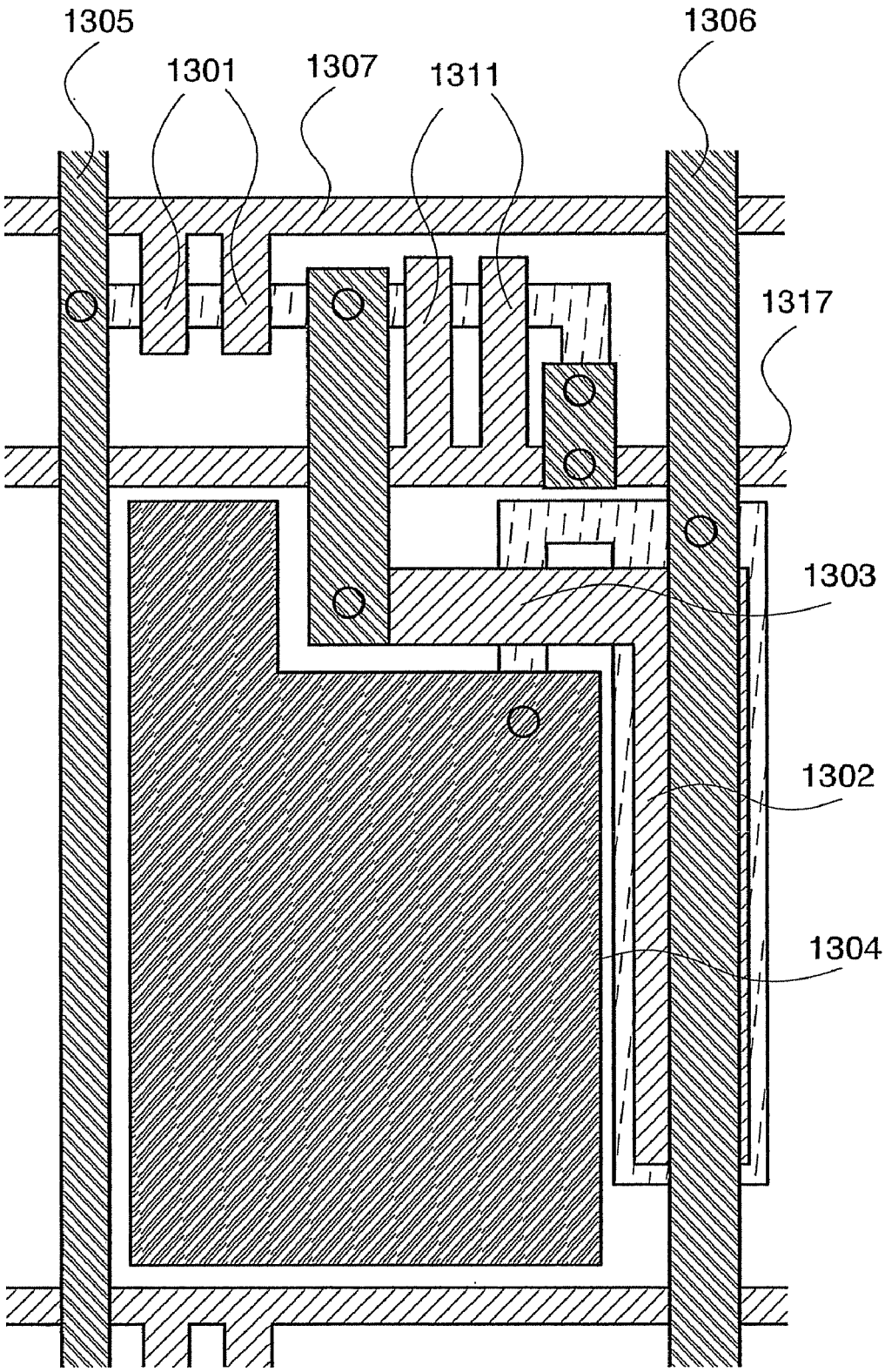
FIG. 13 is a diagram showing a configuration of a display device of the invention.
Figure 14:
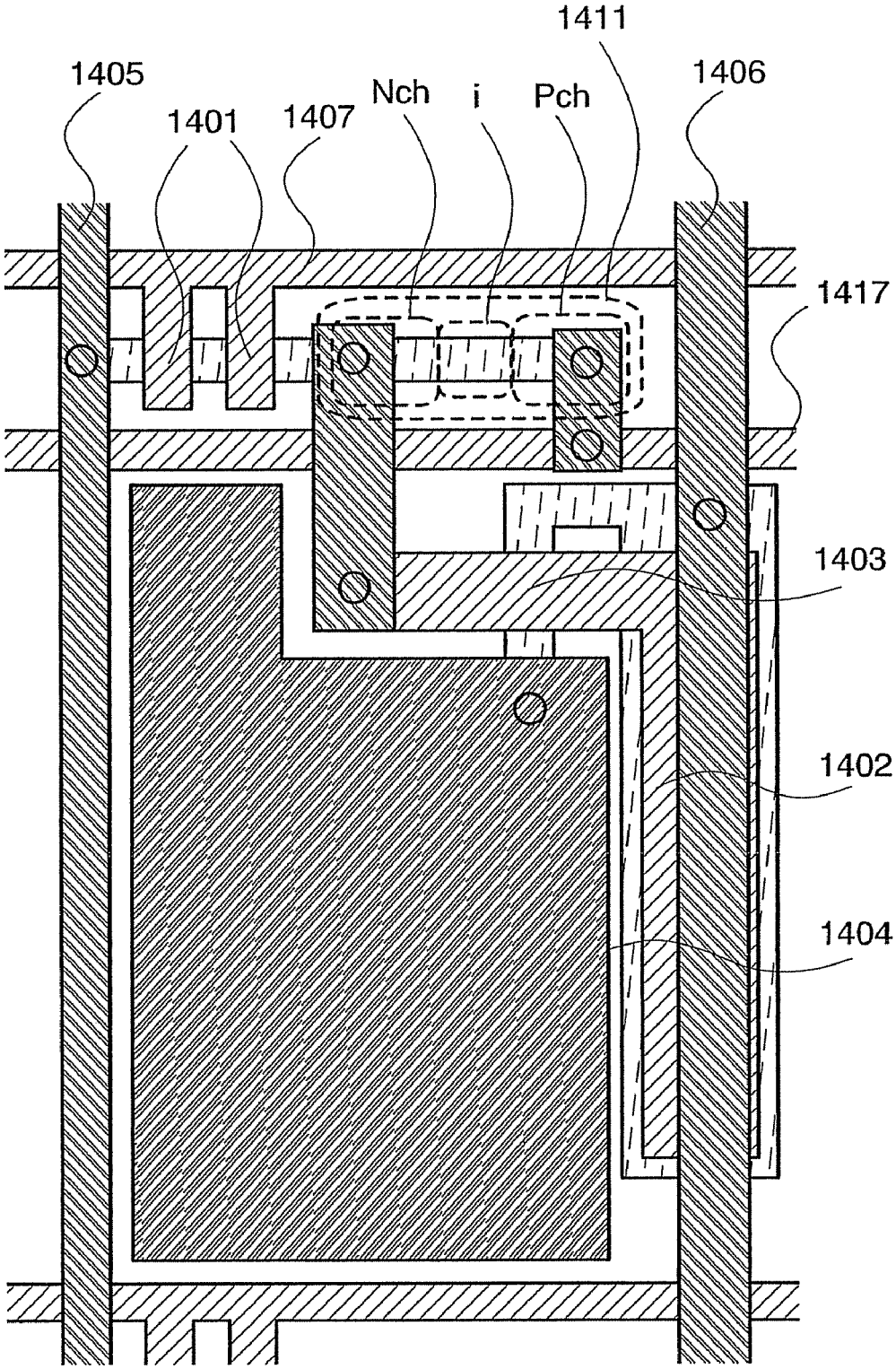
FIG. 14 is a diagram showing a configuration of a display device of the invention.

Next, description is made on a layout of a pixel of a display device of the invention. As an example, FIG. 13 shows a layout of the circuit diagram shown in FIG. 10. Similarly, FIG. 14 shows a layout of the circuit diagram shown in FIG. 9. It is to be noted that the circuit diagram and the layout are not limited to FIGS. 10, 9, 13, and 14.

First, FIG. 13 is referred. FIG. 13 includes a selecting transistor 1301, a driving transistor 1303, a diode-connected erasing transistor 1311, and an electrode 1304 of a display element. A source and a drain of the selecting transistor 1301 are connected to a signal line 1305 and a gate of the driving transistor 1303 respectively. A gate of the selecting transistor 1301 is connected to a first gate line 1307. A source and a drain of the driving transistor 1303 are connected to a power source line 1306 and the electrode 1304 respectively. The diode-connected erasing transistor 1311 is connected to the gate of the driving transistor 1303 and a second gate line 1317. A capacitor 1302 is connected between the gate of the driving transistor 1303 and the power source line 1306.

The signal line 1305 and the power source line 1306 are formed of second wiring while the first gate line 1307 and the second gate line 1317 are formed of first wiring.

Next, FIG. 14 is referred. FIG. 14 includes a selecting transistor 1401, a driving transistor 1403, a diode 1411, and an electrode 1404 of a display element. Here, the diode 1411 is a PIN diode. A source and a drain of the selecting transistor 1401 are connected to a signal line 1405 and a gate of the driving transistor 1403 respectively. A gate of the selecting transistor 1401 is connected to a first gate line 1407. A source and a drain of the driving transistor 1403 are connected to a power source line 1406 and the electrode 1404. The diode 1411 is connected to the gate of the driving transistor 1403 and a second gate line 1417. A capacitor 1402 is connected between the gate of the driving transistor 1403 and the power source line 1406.

A length of an i region of the diode 1411 may be determined in consideration of a breakdown voltage, an off current and the like of the diode 1411. Further, wiring may be provided on an upper or lower side of the i region of the diode 1411. This wiring can prevent the diode from reacting to light.

The signal line 1405 and the power source line 1406 are formed of second wiring while the first gate line 1407 and the second gate line 1417 are formed of first wiring.

In the case of a top gate structure, a substrate, a semiconductor layer, a gate insulating film, first wiring, an interlayer insulating film, and second wiring are formed in this order. In the case of a bottom gate structure, a substrate, first wiring, a gate insulating film, a semiconductor layer, an interlayer insulating film, and second wiring are formed in this order.

It is to be noted that this embodiment mode can be implemented in combination with Embodiment Modes 1 and 2.

Embodiment Mode 4

In this embodiment mode, description is made on hardware which controls the driving method described in Embodiment Modes 1 to 6.

Figure 15:
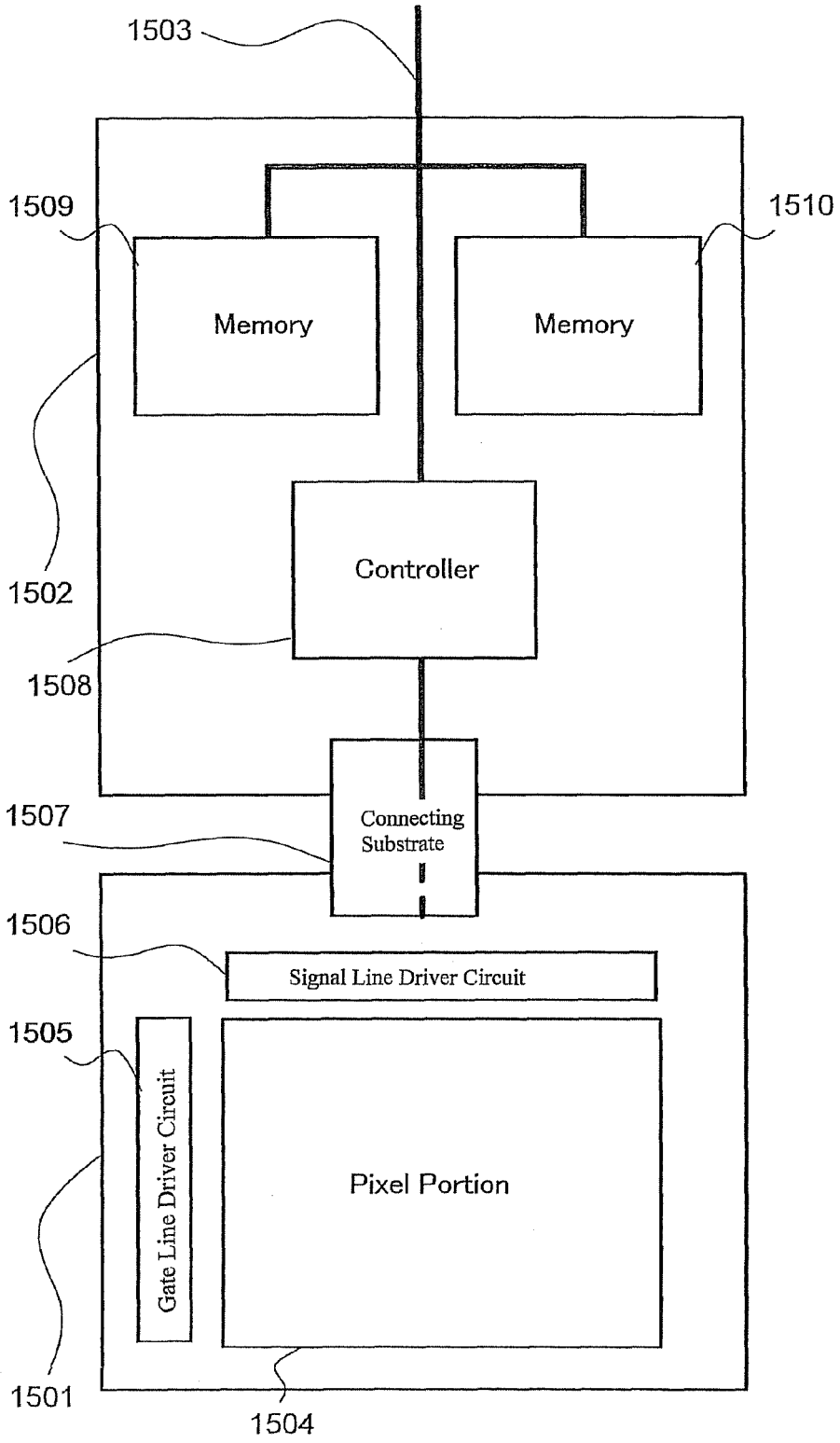
FIG. 15 is a diagram showing a configuration of a display device of the invention.

FIG. 15 shows a brief configuration diagram. A pixel portion 1504 is provided over a substrate 1501. A signal line driver circuit 1506 and a gate line driver circuit 1505 are often provided. Besides, a power source circuit, a precharge circuit, a timing generating circuit and the like are provided in some cases. Further, the signal line driver circuit 1506 and the gate line driver circuit 1505 are not provided in some cases. In that case, the signal line driver circuit 1506 and the gate line driver circuit 1505 are often provided as ICs when they are not provided over the substrate 1501. The IC is often provided over the substrate 1501 by the COG (Chip On Glass) method. Alternatively, the IC may be provided over a connecting substrate 1507 which connects a peripheral circuit substrate 1502 and the substrate 1501.

The peripheral circuit substrate 1502 is inputted with a signal 1503. Then, the signals are stored in memories 1509 and 1510 by a controller 1508. In the case where the signal 1503 is an analog signal, the signal 1503 is applied analog-digital conversion and stored in the memories 1509 and 1510. Then, the controller 1508 outputs a signal to the substrate 1501 by using the signals stored in the memories 1509 and 1510.

In order to realize the driving methods described in Embodiment Modes 1 to 3, the controller 1508 outputs signals to the substrate 1501 by controlling the order that the subframes appear, and the like.

It is to be noted that this embodiment mode can be implemented in combination with Embodiment Modes 1 to 3.

Embodiment Mode 5

Figure 16:
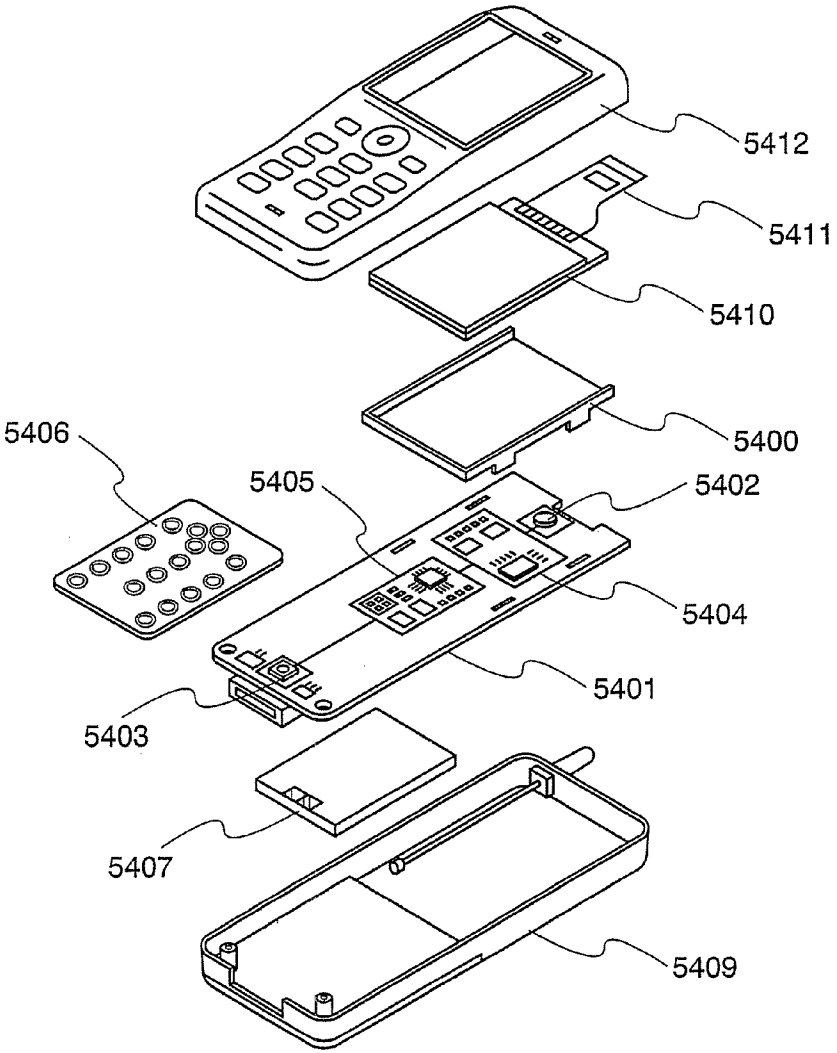
FIG. 16 is a view of an electronic device to which the invention is applied.

Description is made with reference to FIG. 16 on a configuration example of a portable phone having in a display portion a display device using the display device of the invention and the driving method thereof.

A display panel 5410 is detachably incorporated in a housing 5400. The housing 5400 can change a shape and a size appropriately so as to fit the size of the display panel 5410.

The housing 5400 fixed with the display panel 5410 is fixed to a printed substrate 5401 and formed as a module.

The display panel 5410 is connected to the printed substrate 5401 through an FPC 5411. The printed substrate 5401 includes a speaker 5402, a microphone 5403, a transmission/reception circuit 5404, and a signal processing circuit 5405 including a CPU, a controller and the like. Such a module, an input unit 5406, and a battery 5407 are combined and stored in chassis 5409 and 5412. A pixel portion of the display panel 5410 is arranged so as to be seen from an opening window formed in the chassis 5412.

In the display panel 5410, a pixel portion and a portion of a peripheral driver circuit (a driver circuit with a low frequency among a plurality of driver circuits) may be integrated over a substrate by using TFTs and a portion of the peripheral driver circuit (a driver circuit with a high frequency among a plurality of driver circuits) may be formed over an IC chip. The IC chip may be mounted over the display panel 5410 by the COG (Chip On Glass) method. Alternatively, the IC chip may be connected to a glass substrate by the TAB (Tape Auto Bonding) method or using a printed substrate. It is to be noted that FIG. 17A shows a configuration example of a display panel in which a portion of the peripheral driver circuit is integrated over a substrate with a pixel portion and the IC chip provided with another peripheral driver circuit is mounted thereon by the COG method or the like.

Figure 17B:
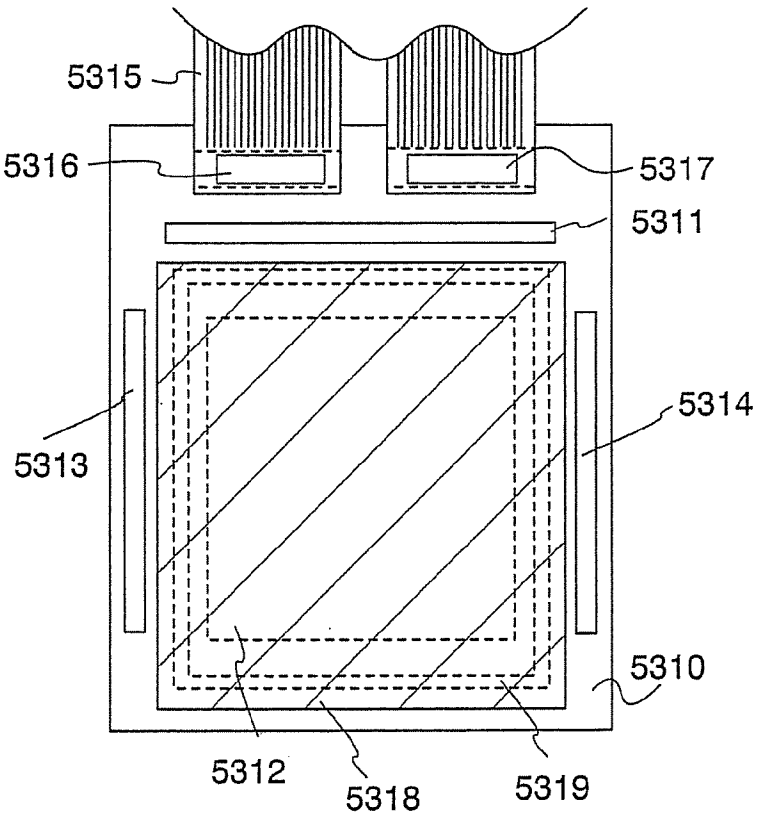
FIGS. 17A and 17B are diagrams showing configurations of a display device of the invention.
Figure 17A:
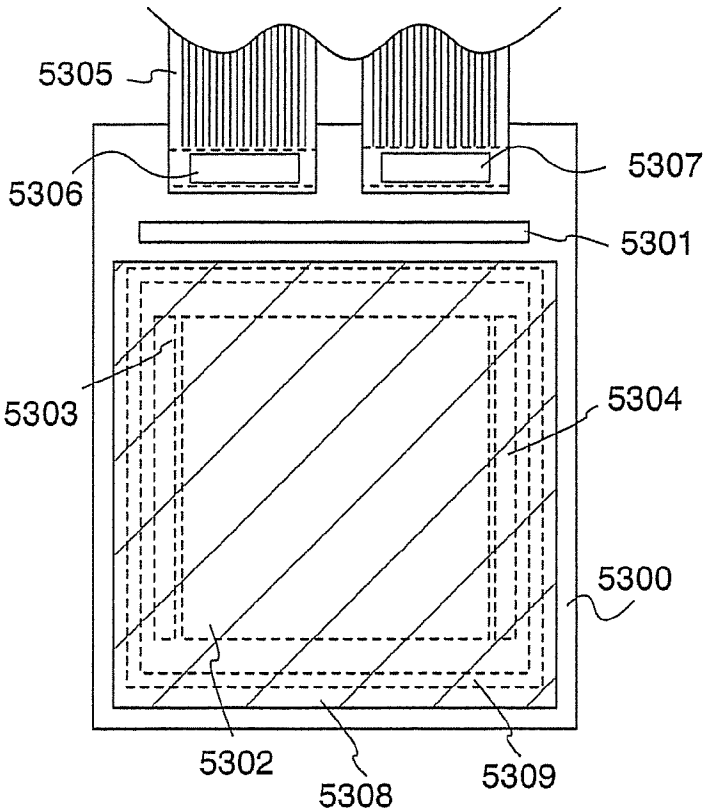

The configuration of the display panel shown in FIG. 17A includes a substrate 5300, signal line driver circuit 5301, a pixel portion 5302, scan line driver circuits 5303 and 5304, an FPC 5305, IC chips 5306 and 5307, a sealing substrate 5308, and a sealing material 5309.

With such a configuration, low power consumption of the display device can be realized and hours of use available by once of charging of a portable phone can be longer. Further, low cost of the portable phone can be realized.

Further, by applying impedance transformation using a buffer to signals which are set at scan lines and signal lines, write time for pixels per row can be shortened. Accordingly, a high resolution display device can be provided.

Further, in order to further reduce the power consumption, a pixel portion may be formed using TFTs over a substrate, all of a peripheral driver circuit may be formed over an IC chip, and the IC chip may be mounted on a display panel by the COG (Chip On Glass) method and the like as shown in FIG. 17B.

It is to be noted that the configuration of the display panel shown in FIG. 17B includes a substrate 5310, a signal line driver circuit 5311, a pixel portion 5312, scan line driver circuits 5313 and 5314, an FPC 5315, IC chips 5316 and 5317, a sealing substrate 5318, and a sealing material 5319.

By using the display device of the invention and the driving method thereof, a clear image with less pseudo contour can be obtained. Accordingly, such an image as a human skin of which gray scale subtly changes can be clearly displayed.

Further, the configuration described in this embodiment mode is an example of a portable phone. The display device of the invention is not limited to a portable phone with such a configuration and can be applied to portable phones with various configurations.

Embodiment Mode 6

Figure 18:
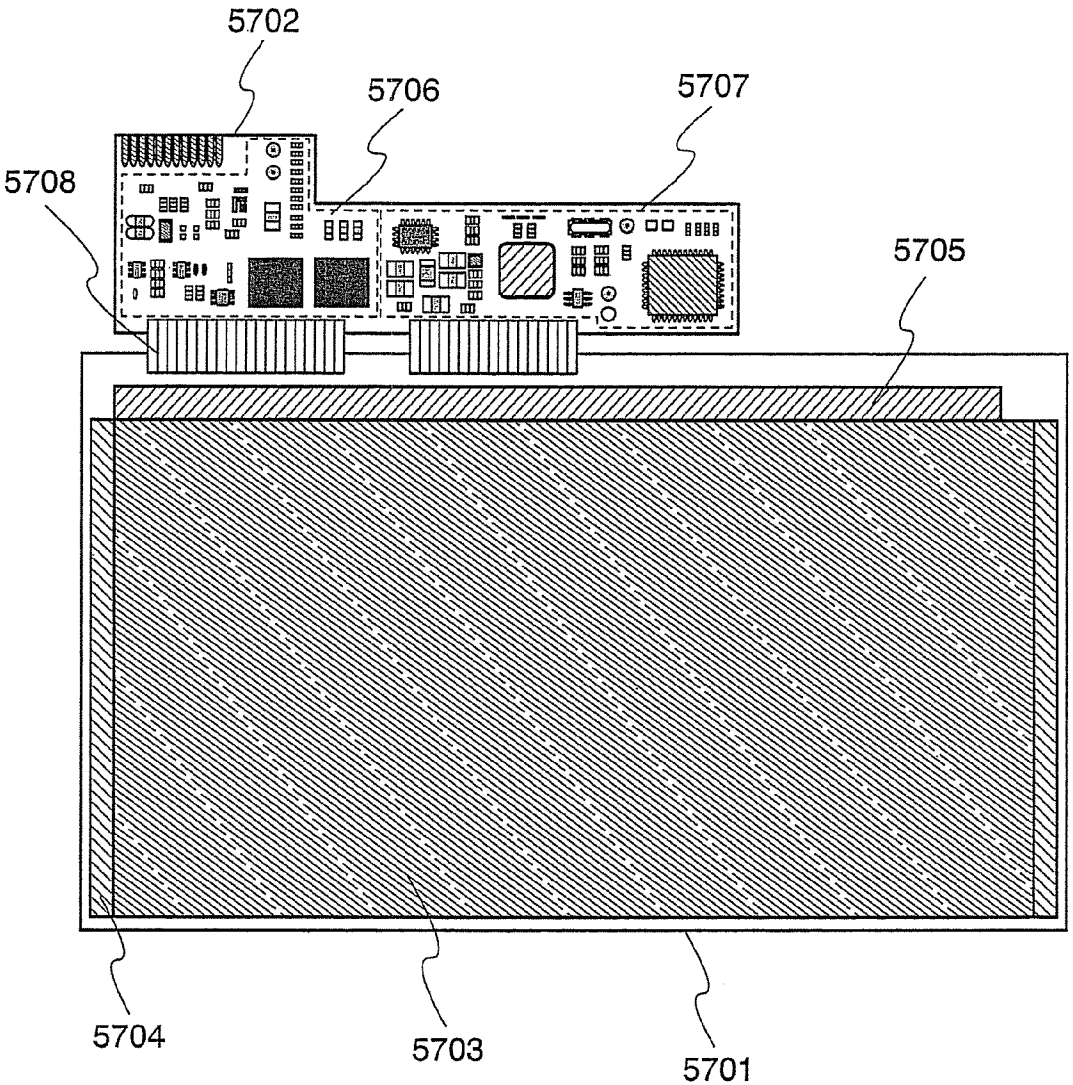
FIG. 18 is a view of an electronic device to which the invention is applied.

FIG. 18 shows an EL module in which a display panel 5701 and a circuit substrate 5702 are incorporated. The display panel 5701 includes a pixel portion 5703, a scan line driver circuit 5704, and a signal line driver circuit 5705. The circuit substrate 5702 includes, for example, a control circuit 5706, a signal divider circuit 5707, and the like. The display panel 5701 and the circuit substrate 5702 are connected through connecting wiring 5708. The connecting wiring may be an FPC or the like.

The control circuit 5706 corresponds to the controller 1508, the memories 1509 and 1510, and the like described in Embodiment Mode 4. The control circuit 5706 mainly controls the order that the subframes appear, and the like.

In the display panel 5701, a pixel portion and a portion of a peripheral driver circuit (a driver circuit with a low frequency among a plurality of driver circuits) may be integrated over a substrate by using TFTs and a portion of the peripheral driver circuit (a driver circuit with a high frequency among a plurality of driver circuits) is formed over an IC chip. The IC chip may be mounted on the display panel 5701 by the COG (Chip On Glass) method. Alternatively, the IC chip may be mounted on the display panel 5701 by the TAB (Tape Auto Bonding) method or using a printed substrate. It is to be noted that FIG. 17A shows the configuration example in which a portion of the peripheral driver circuit is integrated over a substrate with a pixel portion and the IC chip formed as another peripheral driver circuit is mounted by the COG method and the like.

Further, by applying impedance transformation using a buffer to signals which are set at scan lines and signal lines, a write time for pixels per row can be shortened. Accordingly, a high resolution display device can be provided.

Further, in order to further reduce the power consumption, a pixel portion may be formed using TFTs over a glass substrate, all of the signal line driver circuits may be formed over an IC chip, and the IC chip may be mounted on a display panel by the COG (Chip On Glass) method and the like.

It is to be noted that FIG. 17B shows the configuration example in which a pixel portion is formed over a substrate and an IC chip over which a signal line driver circuit is formed is mounted over the substrate by the COG method or the like.

Figure 19:
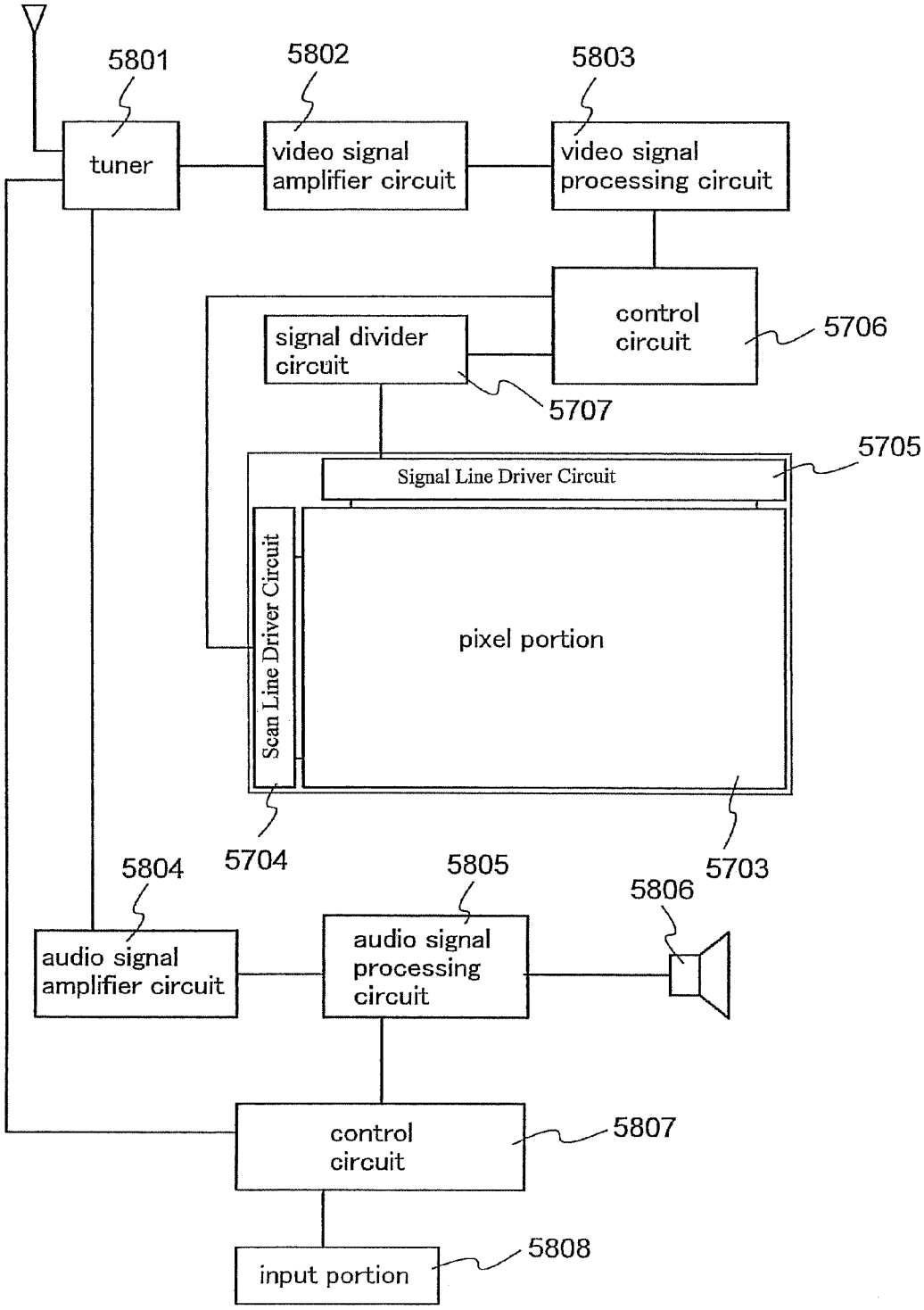
FIG. 19 is a diagram showing a configuration of a display device of the invention.

By using this EL module, an EL television receiver can be completed. FIG. 19 is a block diagram showing a major configuration of the EL television receiver. A tuner 5801 receives video signals and audio signals. The video signals are processed by a video signal amplifier circuit 5802, a video signal processing circuit 5803 which converts the signals outputted from the video signal amplifier circuit 5802 into color signals corresponding each of red, green, and blue, and the control circuit 5706 which converts the video signal into input specification of a driver circuit. The control circuit 5706 outputs signals to a scan line side and a signal line side. In the case of digital drive, the signal divider circuit 5707 is provided on the signal line side and input digital signals may be divided into m to be supplied.

The audio signals received by the tuner 5801 are transmitted to an audio signal amplifier circuit 5804 of which output is supplied to a speaker 5806 through an audio signal processing circuit 5805. The control circuit 5807 receives control data such as receiving station (received frequency) data and volume control data from an input portion 5808, and transmits the signals to the tuner 5801 or the audio signal processing circuit 5805.

By incorporating an EL module into a housing, a television receiver can be completed. The EL module forms a display portion. Further, a speaker, a video input terminal, and the like are appropriately provided.

It is needless to say that the invention is not limited to a television receiver and can be used particularly as a large display medium for various applications such as a monitor of a personal computer, an information display at train stations, airports and the like, and an advertisement board on streets.

In this manner, by using the display device of the invention and the driving method thereof, a clear image with less pseudo contour can be obtained. Accordingly, such an image as a human skin of which gray scale subtly changes can be clearly displayed.

Embodiment Mode 7

Electronic devices to which the invention can be applied are, cameras such as a video camera and a digital camera, a goggle type display, a navigation system, an audio reproducing device (a car audio set, an audio component set, and the like), a computer, a game machine, a portable information terminal (a mobile computer, a portable phone, a portable game machine, an electronic book, or the like), an image reproducing device provided with a recording medium (specifically, a device which reproduces a recording medium such as a DVD (Digital Versatile Disc) and has a display capable of displaying the reproduced image) and the like. Specific examples of these electronic devices are shown in FIGS. 20A to 20H.

Figure 20A:
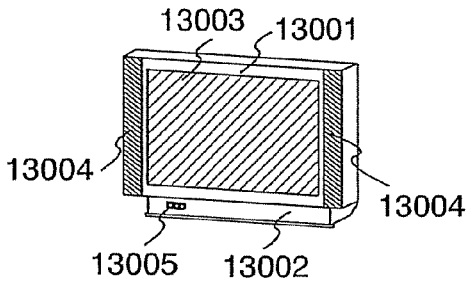
FIGS. 20A to 20H are views of electronic devices to which the invention is applied.

FIG. 20A illustrates a self-luminous display device including a housing 13001, a support base 13002, a display portion 13003, a speaker portion 13004, a video input terminal 13005, and the like. The invention can be used for a display device which forms the display portion 13003. Further, by the invention, a clear image with less pseudo contour can be obtained and the self-luminous display device shown in FIG. 20A can be completed. A self-luminous display device is a self-luminous type, therefore, no backlight is required and a display portion thinner than a liquid crystal display can be obtained. It is to be noted that a self-luminous display device can be used for all display devices for displaying information, such as ones for a personal computer, TV broadcast reception, and advertisement.

Figure 20B:
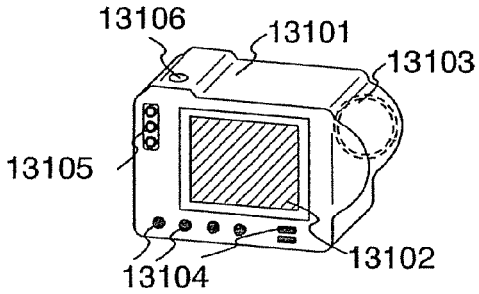

FIG. 20B illustrates a digital camera including a main body 13101, a display portion 13102, an image receiving portion 13103, operating keys 13104, an external connecting port 13105, a shutter 13106, and the like. The invention can be used for a display device which forms the display portion 13102. Further, by the invention, a clear image with less pseudo contour can be obtained and the digital camera shown in FIG. 20B can be completed.

Figure 20C:
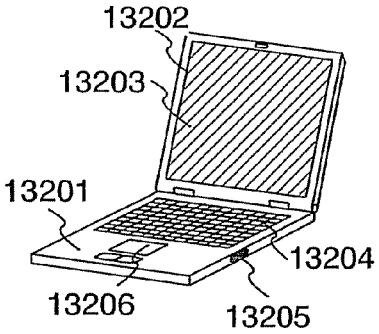

FIG. 20C illustrates a computer including a main body 13201, a housing 13202, a display portion 13203, a keyboard 13204, an external connecting port 13205, a pointing mouse 13206 and the like. The invention can be used for a display device which forms the display portion 13203. Further, by the invention, a clear image with less pseudo contour can be obtained and the computer shown in FIG. 20C can be completed.

Figure 20D:
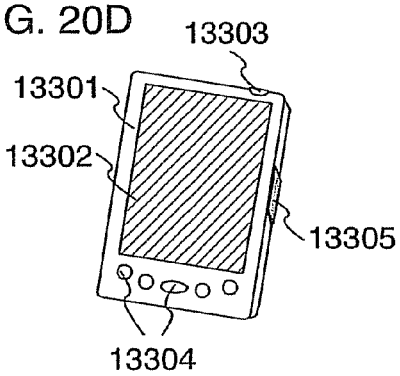

FIG. 20D illustrates a mobile computer including a main body 13301, a display portion 13302, a switch 13303, operating keys 13304, an infrared port 13305, and the like. The invention can be used for a display device which forms the display portion 13302. Further, by the invention, a clear image with less pseudo contour can be obtained and the mobile computer shown in FIG. 20D can be completed.

Figure 20E:
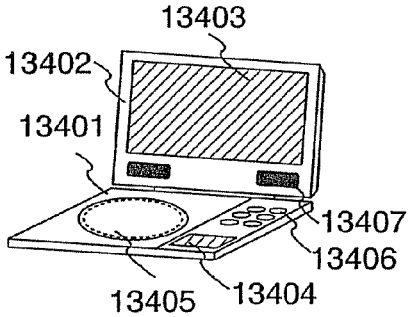

FIG. 20E illustrates a portable image reproducing device (specifically a DVD reproducing device) provided with a recording medium reading portion, including a main body 13401, a housing 13402, a display portion A 13403, a display portion B 13404, a recording medium (DVD or the like) reading portion 13405, an operating key 13406, a speaker portion 13407, and the like. The display portion A 13403 mainly displays image data while the display portion B 13404 mainly displays text data. The invention can be used for a display device which forms the display portion A 13403 and the display portion B 13404. It is to be noted that the image reproducing device provided with a recording medium reading portion includes a home game machine and the like. Further, by the invention, a clear image with less pseudo contour can be obtained and the image reproducing device shown in FIG. 20E can be completed.

Figure 20F:
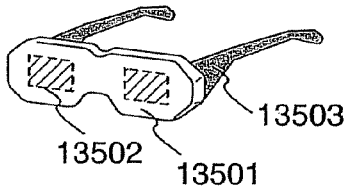

FIG. 20F illustrates a goggle type display including a main body 13501, a display portion 13502, and an arm portion 13503. The invention can be used for a display device which forms the display portion 13502. Further, by the invention, a clear image with less pseudo contour can be obtained and the goggle type display shown in FIG. 20F can be completed.

Figure 20G:
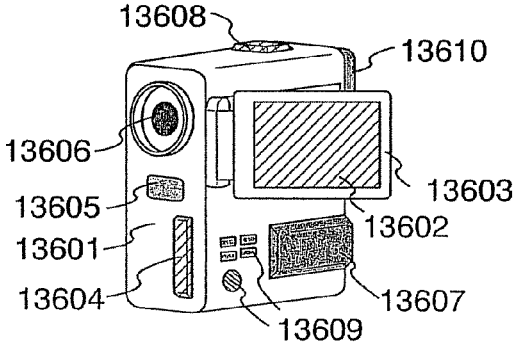

FIG. 20G illustrates a video camera including a main body 13601, a display portion 13602, a housing 13603, an external connecting port 13604, a remote control receiving portion 13605, an image receiving portion 13606, a battery 13607, an audio input portion 13608, operating keys 13609, an ocular portion 13610 and the like. The invention can be used for a display device which forms the display portion 13602. Further, by the invention, a clear image with less pseudo contour can be obtained and the video camera shown in FIG. 20G can be completed.

Figure 20H:
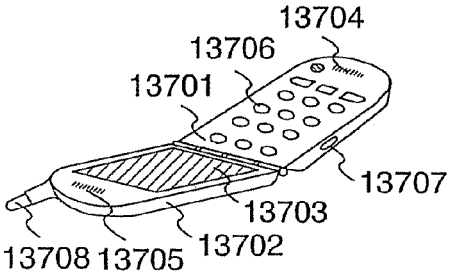
Figure 21:
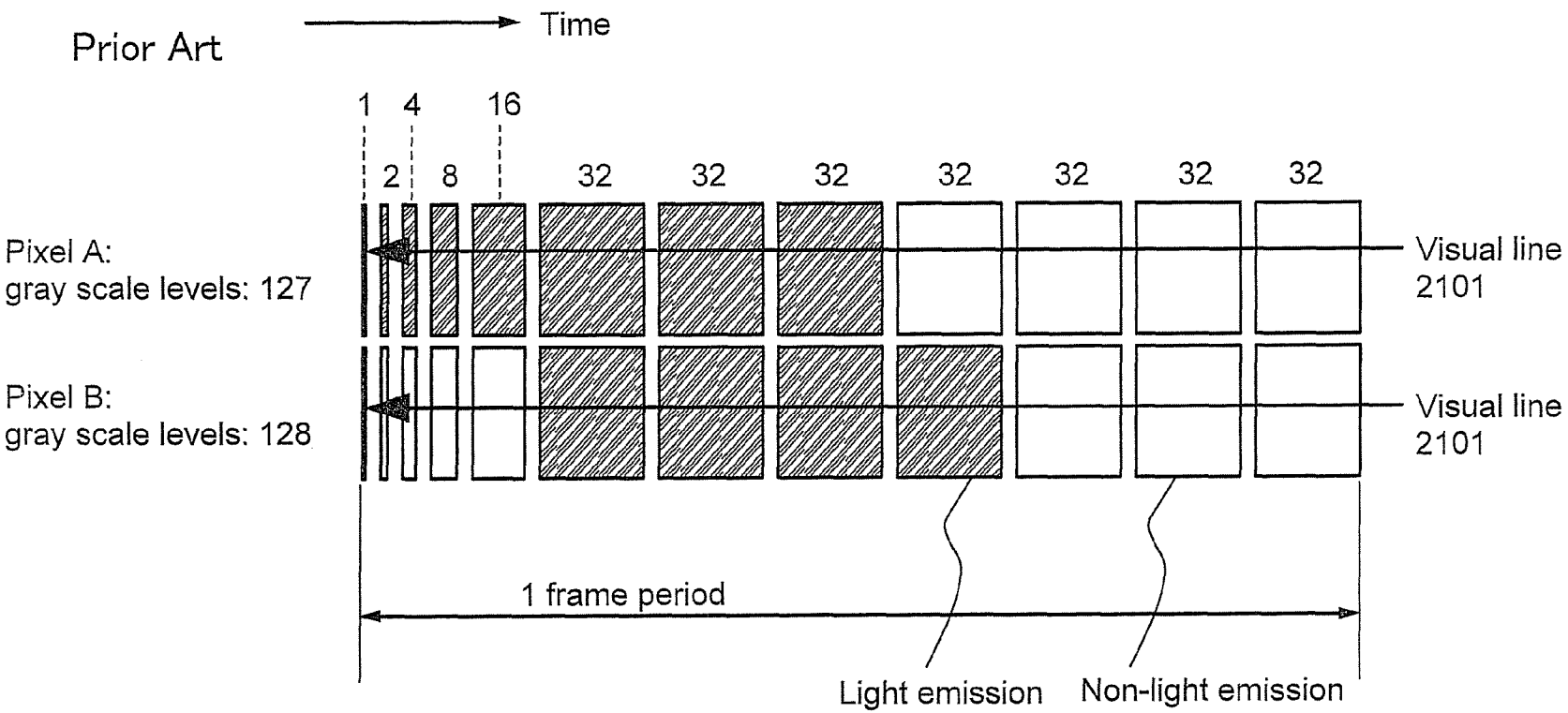
FIG. 21 Prior Art
FIG. 21 is a diagram showing a configuration of a driving method of a conventional display device.
Figure 22:
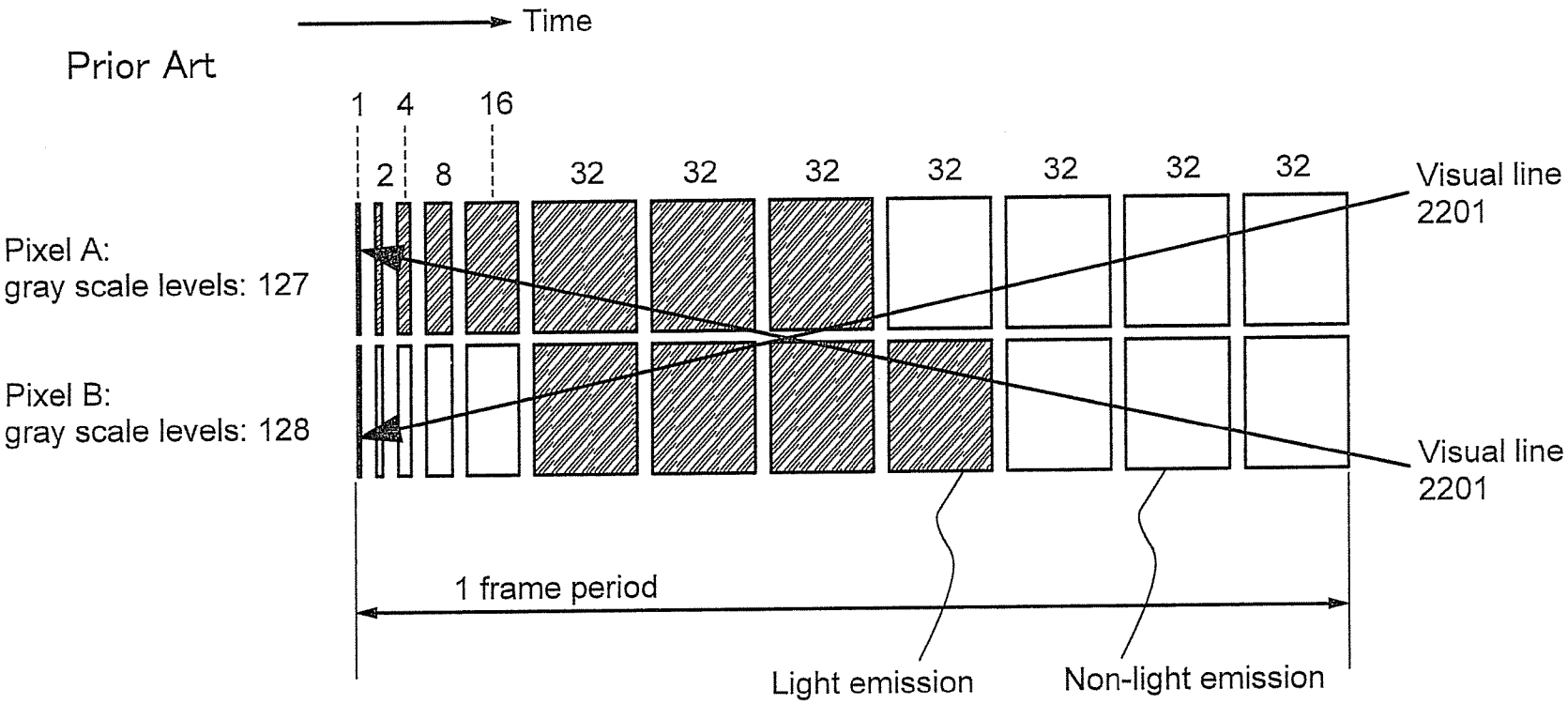
FIG. 22 Prior Art
FIG. 22 is a diagram showing a configuration of a driving method of a conventional display device.
Figure 23:
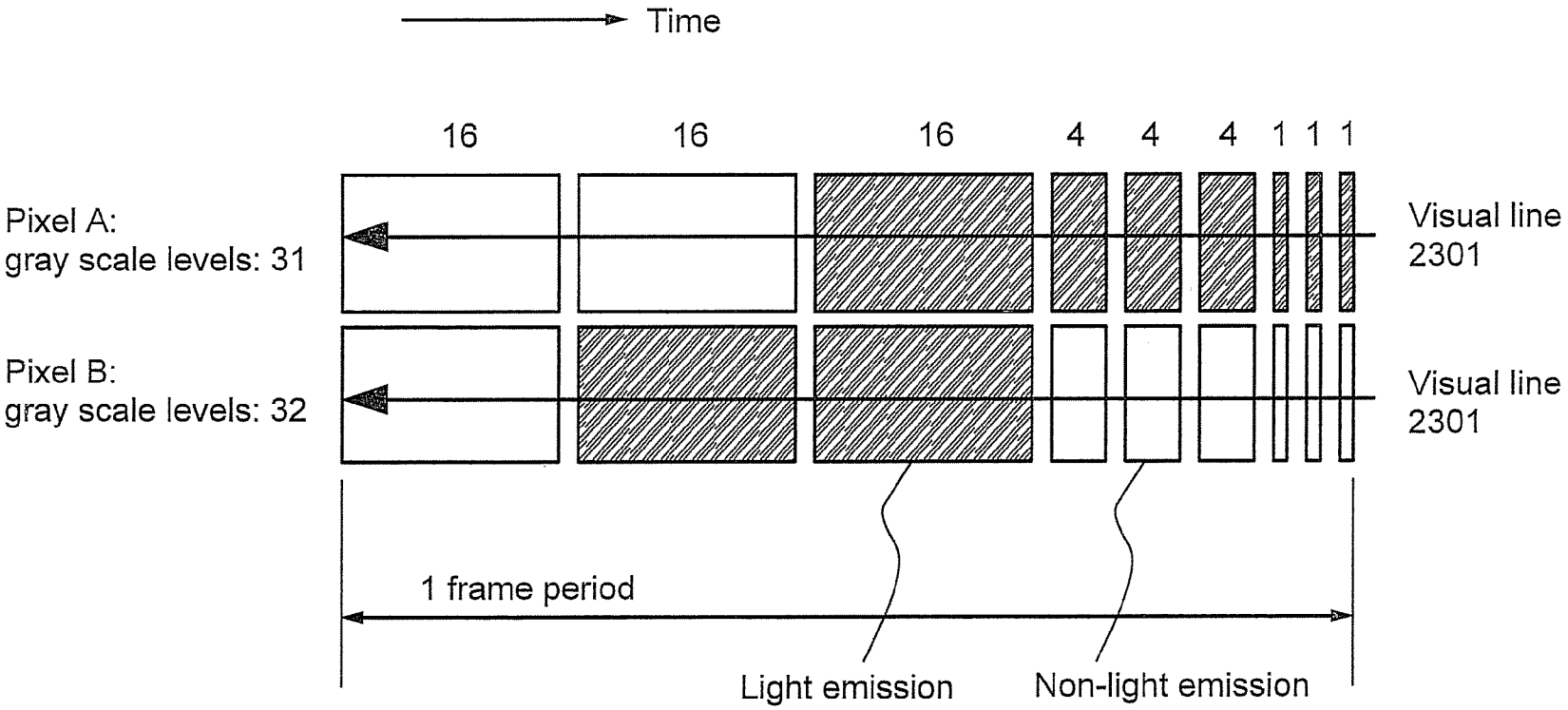
FIG. 23 Prior Art
FIG. 23 is a diagram showing a configuration of a driving method of a conventional display device.
Figure 24:
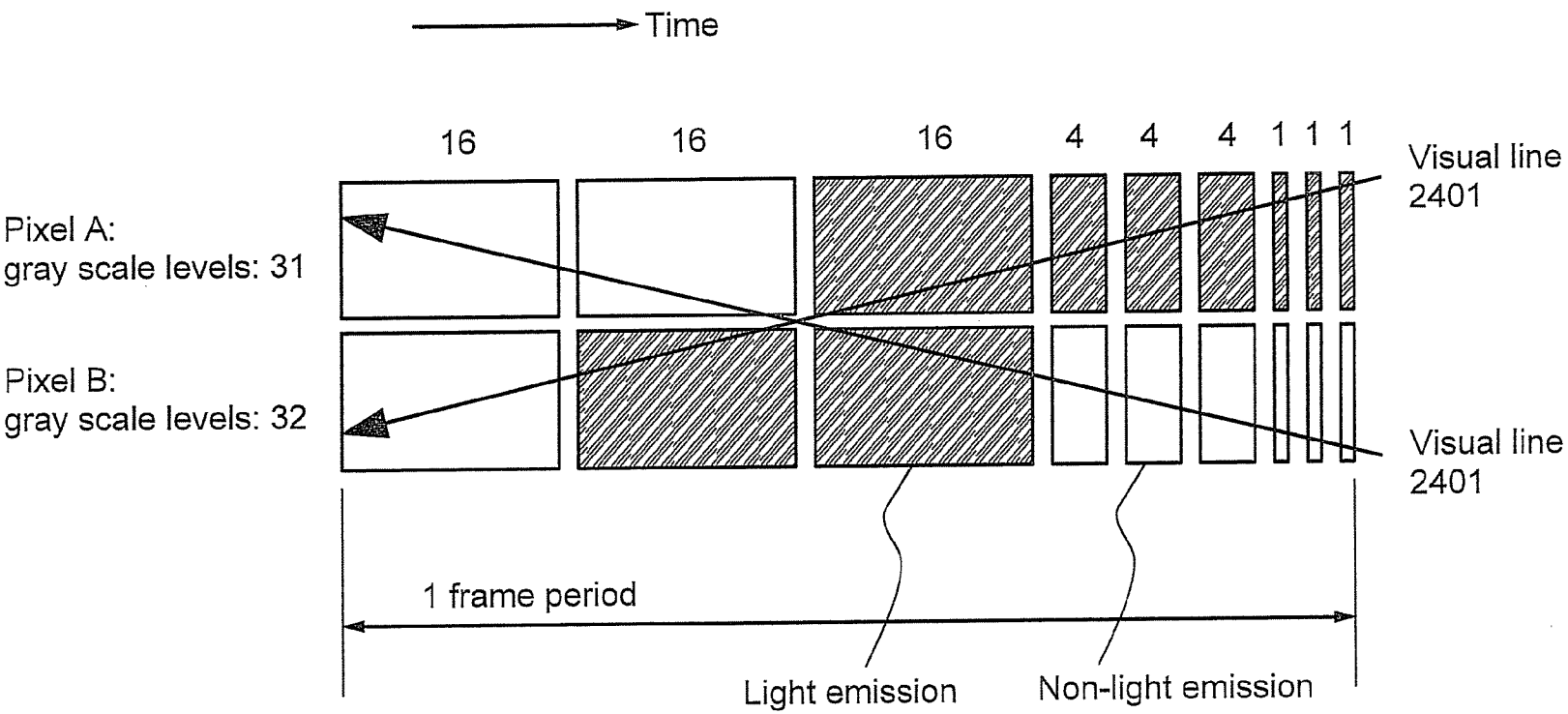
FIG. 24 Prior Art
FIG. 24 is a diagram showing a configuration of a driving method of a conventional display device.

FIG. 20H illustrates a portable phone including a main body 13701, a housing 13702, a display portion 13703, an audio input portion 13704, an audio output portion 13705, an operating key 13706, an external connecting port 13707, an antenna 13708, and the like. The invention can be used for a display device which forms the display portion 13703. It is to be noted that power consumption of the portable phone can be suppressed when the display portion 13703 displays white text on a black background. Further, by the invention, a clear image with less pseudo contour can be obtained and the portable phone shown in FIG. 20H can be completed.

By using a light emitting material with high luminance, the light including outputted image data can be expanded and projected by using a lens and the like to be used for a front or rear type projector.

Furthermore, the aforementioned electronic apparatuses are becoming to be more used for displaying information distributed through a telecommunication path such as Internet, a CATV (cable television system), and in particular for displaying moving picture information. The light emitting device is suitable for displaying moving pictures since the light emitting material can exhibit high response speed.

It is preferable to display data with as small light emitting portion as possible because the light emitting device consumes power in the light emitting portion. Therefore, in the case of using the light emitting device in the display portions of the portable information terminal, in particular a portable phone, an audio reproducing device, or the like which mainly displays text data, it is preferable to drive so that the text data is formed by a light emitting portion with a non-light emitting portion as a background.

As described above, the application range of the invention is so wide that the invention can be used in various fields of electronic devices. The electronic devices described in this embodiment mode can use any configuration of the display device described in Embodiment Modes 1 to 6.

This application is based on Japanese Patent Application serial no. 2005-008419 filed in Japan Patent Office on 14 Jan. 2005, the entire contents of which are hereby incorporated by reference.

What is claimed is:

1. A display device having a pixel comprising a first transistor, a second transistor, a third transistor, a capacitor, a first wiring, a second wiring, a third wiring, a fourth wiring, a fifth wiring, a sixth wiring, and a light emitting display element, wherein one of a source and a drain of the first transistor is electrically connected to the first wiring, wherein the other of the source and the drain of the first transistor is electrically connected to the fifth wiring, wherein a gate of the first transistor is electrically connected to the third wiring, wherein one of a source and a drain of the second transistor is electrically connected to the second wiring, wherein the other of the source and the drain of the second transistor is electrically connected to the light emitting display element, wherein a gate of the second transistor is electrically connected to the fifth wiring, wherein one of a source and a drain of the third transistor is electrically connected to the other of the source and the drain of the first transistor and the fifth wiring, wherein the other of the source and the drain of the third transistor is electrically connected to the fourth wiring through the sixth wiring, wherein a gate of the third transistor is electrically connected to the fourth wiring, wherein one electrode of the capacitor is electrically connected to the gate of the second transistor, wherein the other electrode of the capacitor is electrically connected to the one of the source and the drain of the second transistor, wherein the first wiring, the second wiring, the fifth wiring, and the sixth wiring are formed using a first same wiring layer, wherein the third wiring and the fourth wiring are formed using a second same wiring layer which is different from the first same wiring layer, wherein a semiconductor layer in the first transistor and a semiconductor layer in the third transistor are included in a first same semiconductor layer, wherein the gate of the first transistor is included in the third wiring, wherein the gate of the third transistor is included in the fourth wiring, and wherein the fifth wiring intersects with the fourth wiring and does not intersect with the third wiring, wherein the first wiring correspond to a signal line, the second wiring correspond to a power source line, the third wiring correspond to a first gate line and the fourth wiring correspond to a second gate line, and wherein the third transistor functions as a diode.

2. A module comprising the display device according to claim 1.

3. An electronic book comprising the display device according to claim 1.

4. A display device having a pixel comprising a first transistor, a second transistor, a third transistor, a capacitor, a first wiring, a second wiring, a third wiring, a fourth wiring, a fifth wiring, a sixth wiring, and a light emitting display element, wherein one of a source and a drain of the first transistor is electrically connected to the first wiring, wherein the other of the source and the drain of the first transistor is electrically connected to the fifth wiring, wherein a gate of the first transistor is electrically connected to the third wiring, wherein one of a source and a drain of the second transistor is electrically connected to the second wiring, wherein the other of the source and the drain of the second transistor is electrically connected to the light emitting display element, wherein a gate of the second transistor is electrically connected to the fifth wiring, wherein one of a source and a drain of the third transistor is electrically connected to the other of the source and the drain of the first transistor and the fifth wiring, wherein the other of the source and the drain of the third transistor is electrically connected to the fourth wiring through the sixth wiring, wherein a gate of the third transistor is electrically connected to the fourth wiring, wherein one electrode of the capacitor is electrically connected to the gate of the second transistor, wherein the other electrode of the capacitor is electrically connected to the one of the source and the drain of the second transistor, wherein the first wiring, the second wiring, the fifth wiring, and the sixth wiring are formed using a first same wiring layer, wherein the third wiring and the fourth wiring are formed using a second same wiring layer which is different from the first same wiring layer, wherein a semiconductor layer in the first transistor and a semiconductor layer in the third transistor are included in a first same semiconductor layer, wherein the gate of the first transistor is included in the third wiring, wherein the gate of the third transistor is included in the fourth wiring, and wherein the fifth wiring intersects with the fourth wiring and does not intersect with the third wiring, wherein the first wiring, the second wiring and the fifth wiring are formed in parallel, wherein the first wiring correspond to a signal line, the second wiring correspond to a power source line, the third wiring correspond to a first gate line and the fourth wiring correspond to a second gate line, and wherein the third transistor functions as a diode.

5. A module comprising the display device according to claim 4.

6. An electronic book comprising the display device according to claim 4.

7. A display device having a pixel comprising a first transistor, a second transistor, a third transistor, a capacitor, a first wiring, a second wiring, a third wiring, a fourth wiring, a fifth wiring, a sixth wiring, and a light emitting display element, wherein one of a source and a drain of the first transistor is electrically connected to the first wiring, wherein the other of the source and the drain of the first transistor is electrically connected to the fifth wiring, wherein a gate of the first transistor is electrically connected to the third wiring, wherein one of a source and a drain of the second transistor is electrically connected to the second wiring, wherein the other of the source and the drain of the second transistor is electrically connected to the light emitting display element, wherein a gate of the second transistor is electrically connected to the fifth wiring, wherein one of a source and a drain of the third transistor is electrically connected to the other of the source and the drain of the first transistor and the fifth wiring, wherein the other of the source and the drain of the third transistor is electrically connected to the fourth wiring through the sixth wiring, wherein a gate of the third transistor is electrically connected to the fourth wiring, wherein one electrode of the capacitor is electrically connected to the gate of the second transistor, wherein the other electrode of the capacitor is electrically connected to the one of the source and the drain of the second transistor, wherein the first wiring, the second wiring, the fifth wiring, and the sixth wiring are formed using a first same wiring layer, wherein the third wiring and the fourth wiring are formed using a second same wiring layer which is different from the first same wiring layer, wherein a semiconductor layer in the first transistor and a semiconductor layer in the third transistor are included in a first same semiconductor layer, wherein the gate of the first transistor is included in the third wiring, wherein the gate of the third transistor is included in the fourth wiring, and wherein the fifth wiring intersects with the fourth wiring and does not intersect with the third wiring, wherein the capacitor and the second wiring are overlapped with each other, wherein the first wiring correspond to a signal line, the second wiring correspond to a power source line, the third wiring correspond to a first gate line and the fourth wiring correspond to a second gate line, and wherein the third transistor functions as a diode.

8. The display device according to claim 7, wherein the first wiring, the second wiring, and the fifth wiring are formed in parallel.

9. A module comprising the display device according to claim 7.

10. An electronic book comprising the display device according to claim 7.

* * * * *